US006782629B2

(12) United States Patent
Jimenez et al.

(10) Patent No.: US 6,782,629 B2
(45) Date of Patent: Aug. 31, 2004

(54) STRAIGHT EDGE TO FACILITATE HOLDING AND MEASURING AND TO PROVIDE PROTECTION WHEN CUTTING

(75) Inventors: Eduardo J. Jimenez, Avon, CT (US); Dan Seymour, Burlington, CT (US); Terry Prive, Southington, CT (US); Miguel Mistal, Avon, CT (US); John C. Murray, Canton, CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/852,051

(22) Filed: May 10, 2001

(65) Prior Publication Data

US 2002/0166250 A1 Nov. 14, 2002

(51) Int. Cl.[7] ..... B43L 7/00

(52) U.S. Cl. ..... 33/483; 33/758; 33/494

(58) Field of Search ..... 33/483, 484, 485, 33/489, 492, 427, 429, 474, 481, 32.1, 32.3, 496, 490, 493, 494, 757, 759, 760, 770, 758, 567

(56) References Cited

U.S. PATENT DOCUMENTS

| | | | |
|---|---|---|---|
| 51,609 | A | 12/1865 | Munson |
| 118,225 | A | 8/1871 | Feusier, Jr. |
| 145,555 | A | 12/1873 | Combes |
| 146,673 | A | 1/1874 | Haslett |
| 147,943 | A | 2/1874 | Joy |
| 151,928 | A | 6/1874 | Soper |
| 185,102 | A | 12/1876 | Hays |
| 218,764 | A | 8/1879 | Mosher |
| 233,203 | A | 10/1880 | Cushman |
| 287,480 | A | 10/1883 | Smith |
| 325,992 | A | 8/1885 | Thain |
| 332,958 | A | 12/1885 | Smith |
| D18,121 | S | 10/1888 | McKercher |
| 422,033 | A | 2/1890 | Nisley |
| 422,701 | A | 3/1890 | Benzinger |

(List continued on next page.)

FOREIGN PATENT DOCUMENTS

| | | | |
|---|---|---|---|
| DE | 905 888 | | 3/1954 |
| DE | 2 019 453 | | 4/1970 |
| DE | 261829 | A * | 7/1987 |
| DE | 4317819 | * | 12/1994 |
| FR | 900 735 | | 7/1945 |
| GB | 2 180 799 | | 4/1987 |
| IT | 600 262 | | 11/1959 |
| JP | 62-81501 | | 4/1987 |
| JP | 05139089 | A * | 6/1993 |

OTHER PUBLICATIONS

Speedpress Catalogue, Aluminum Safety Ruler, Apr. 14, 2000.*

Eugene Dietzgen, Triangle Scales, Feb. 27, 1957.

*Primary Examiner*—Diego Gutierrez
*Assistant Examiner*—Tania Courson
(74) *Attorney, Agent, or Firm*—Pillsbury Winthrop LLP

(57) ABSTRACT

A guiding device wherein an illustrated embodiment of the guiding device includes an elongated finger-resting surface, an elongated upstanding section, and an elongated first scale-supporting section. The upstanding section is positioned between the first scale-supporting section and the finger-resting section. The first scale is an elongated, narrow strip having a first scale surface rigidly and unreleasably attached to the first scale-supporting section of the second portion. The first scale has a second scale surface opposite to the first scale surface. The second scale surface has first indicia to indicate predetermined lengths along the first scale. The finger-resting surface permits fingers of a user gripping the guiding device to be positioned on the finger-resting surface while being protected from an implement by the upstanding section during movement of the implement along the guiding device, adjacent the first scale.

34 Claims, 28 Drawing Sheets

U.S. PATENT DOCUMENTS

| | | | | | |
|---|---|---|---|---|---|
| 431,568 | A | | 7/1890 | Esser | |
| 434,660 | A | | 8/1890 | Fitzgerald | |
| 443,652 | A | | 12/1890 | Jewell | |
| 466,226 | A | | 12/1891 | Faunce | |
| 470,754 | A | | 3/1892 | Hartig | |
| 476,482 | A | | 6/1892 | Oliver | |
| 538,709 | A | | 5/1895 | Spafard | |
| 563,510 | A | * | 7/1896 | Savidge | 33/566 |
| 566,195 | A | * | 8/1896 | Leavitt | 33/485 |
| 656,413 | A | | 8/1900 | Meux | |
| 703,208 | A | * | 6/1902 | Lawrence | 33/493 |
| 833,168 | A | | 10/1906 | Keller | |
| 963,001 | A | | 6/1910 | Dibrell | |
| 1,085,905 | A | | 2/1914 | Hagey | |
| 1,091,461 | A | * | 3/1914 | Russo | 33/486 |
| 1,107,432 | A | | 8/1914 | Mantz | |
| 1,396,806 | A | | 11/1921 | Beals | |
| 1,602,490 | A | | 10/1926 | Homan | |
| 1,677,821 | A | | 7/1928 | Graham | |
| 2,124,550 | A | | 7/1938 | Evans | |
| 2,247,157 | A | * | 6/1941 | Little | 33/492 |
| 2,252,311 | A | | 8/1941 | Ware | |
| 2,382,758 | A | | 8/1945 | Weeks et al. | |
| 2,410,696 | A | | 11/1946 | Wheeler | |
| 2,423,779 | A | | 7/1947 | Kahn | |
| 2,438,653 | A | | 3/1948 | Ware | |
| 2,504,251 | A | | 4/1950 | Coffey | |
| 2,645,019 | A | * | 7/1953 | Jones | 33/464 |
| 2,673,399 | A | | 3/1954 | Raeder | |
| D172,784 | S | | 8/1954 | Cupp | |
| 2,932,897 | A | * | 4/1960 | Huber | 33/758 |
| 3,087,250 | A | | 4/1963 | Blue | |
| 3,310,878 | A | | 3/1967 | Giba | |
| 3,406,456 | A | | 10/1968 | Schleich | |
| 3,465,453 | A | | 9/1969 | Sganga | |
| D244,090 | S | * | 4/1977 | West | D19/35 |
| 4,089,116 | A | | 5/1978 | Bearinger | |
| 4,149,320 | A | * | 4/1979 | Troyer et al. | 33/758 |
| 4,484,395 | A | | 11/1984 | Samuels | |
| 4,495,709 | A | | 1/1985 | Mainenti | |
| D280,081 | S | | 8/1985 | Groves | |
| 4,601,598 | A | * | 7/1986 | Schwartz et al. | 401/6 |
| 4,660,292 | A | | 4/1987 | Richardson | |
| 5,012,590 | A | * | 5/1991 | Wagner et al. | 33/759 |
| 5,097,617 | A | | 3/1992 | Craven | |
| D364,177 | S | * | 11/1995 | Lewis | D15/138 |
| D374,404 | S | * | 10/1996 | Kidd | D10/71 |
| 5,653,415 | A | * | 8/1997 | Schworer | 248/354.1 |
| D386,316 | S | * | 11/1997 | Fischer et al. | D4/138 |
| D390,078 | S | | 2/1998 | Williams | |
| 5,842,402 | A | | 12/1998 | Collier | |
| 5,873,171 | A | * | 2/1999 | Hsu | 33/484 |
| 6,159,292 | A | | 12/2000 | Hsu | |
| 6,305,093 | B1 | * | 10/2001 | Venola | 33/451 |
| 6,349,479 | B1 | * | 2/2002 | Bottega | 33/481 |
| 6,360,448 | B1 | * | 3/2002 | Smyj | 33/562 |
| 2002/0095804 | A1 | * | 7/2002 | Coplan | 33/484 |

* cited by examiner

STRAIGHT EDGE TO FACILITATE HOLDING AND MEASURING AND TO PROVIDE PROTECTION WHEN CUTTING

BACKGROUND OF THE INVENTION

1. Field of the Invention

This invention relates to guiding devices, and more particularly, to guiding devices including a scale.

2. Description of Related Art

Straight edges and are generally formed into a flat, rectangular profile having at least one straight edge with measurement markings thereon. The measurement markings allow a user to measure various objects along the straight edge. During typical use of such straight edges, a straight edge is placed against a surface and a tool is moved along the straight edge. Such tools include a marking tool for making measurements on the surface and a cutting tool for cutting materials, such as dry wall. However, straight edges of this type can be difficult to grip and hold against the surface to be marked or cut due to the flat, rectangular profile of the straight edge.

Additionally, the measurement markings on guiding devices of this type are usually molded into an exterior surface of the straight edge or printed on an exterior surface of the straight edge with ink so as to be visible to a user. Over a period of time, however, the ink used in molding and printing of the measurement markings on such straight edges tends to wear out or rub off, thus, rendering the straight edge almost useless because the measurement markings are too difficult for the user to see.

SUMMARY OF THE INVENTION

An object of the illustrated embodiment of the invention is to provide an improved guiding device including an elongated finger-resting surface; an elongated upstanding section projecting upwardly from said finger-resting surface; an elongated scale-supporting section coupled to and extending along said upstanding section with said upstanding section being positioned between said first scale-supporting section and said finger-resting surface, said scale-supporting section being inclined with respect to a guiding device supporting surface; and an elongated first scale made of metal and having a lower surface and an upper surface, said lower surface being rigidly and unreleasably attached to said first scale-supporting section and said upper surface having first indicia to indicate predetermined lengths along said first scale, and said finger-resting surface permitting fingers of a user gripping said guiding device to be positioned on said finger-resting surface while being protected from an implement by said upstanding section during movement of the implement along said guiding device adjacent said first scale.

Another object of the illustrated embodiment of the invention is to provide a guiding device, comprising: an elongated, first portion having a finger-resting surface and a bottom surface opposite to said finger-resting surface; an elongated, second portion extending along said first portion, said second portion having an upstanding section and an inclined scale-supporting section, said upstanding section projecting upwardly from said finger-resting surface and having an uppermost free end, said upstanding section being positioned between said scale-supporting section and said first portions, said first and second portions having a generally T-shaped cross-section; and an elongated first scale having a lower surface rigidly and unreleasably attached to said scale-supporting section, an upper surface having first indicia to indicate predetermined lengths along said first scale, an innermost edge positioned closest to said free end of said upstanding section, and an outmost edge remote from said innermost edge, said bottom surface of said first portion being configured to be placed against a substantially flat working surface, and said upper surface of said first scale being inclined with respect to the working surface such that said innermost edge of said first scale is further from the working surface than said outermost edge of said first scale, and said finger-resting surface permitting fingers of a user gripping said guiding device to be positioned on said finger-resting surface while being protected from an implement by said upstanding section during movement of the implement along said guiding device, adjacent said first scale.

DETAILED DESCRIPTION OF PREFERRED EMBODIMENTS OF THE INVENTION

Figure 1:
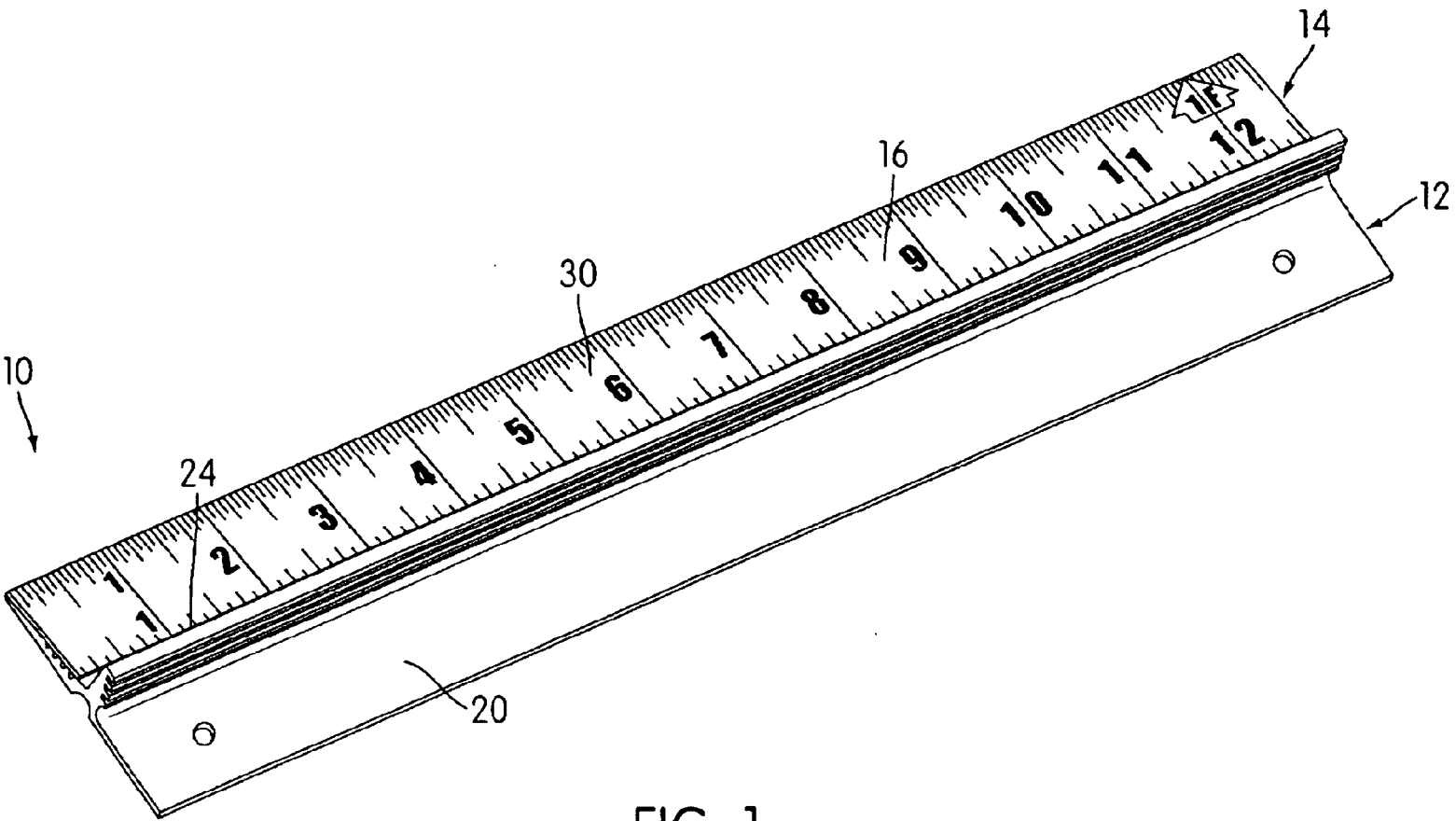
FIG. 1 is a perspective view of a guiding device embodying the principles of a first illustrated embodiment of the present invention.

In FIGS. 1–4, there is shown a guiding device, generally indicated at 10, embodying the principles of an illustrated embodiment of the present invention. The guiding device 10 is in the form of a straightedge that can have both upper and lower scales and a generally T-shaped cross section to facilitate handling of the straight edge and to provide protection to the user's hand that is holding the straightedge 10 while the user runs an implement, such as a knife, along the straightedge 10.

The guiding device 10 comprises an elongated first portion 12 and an elongated second portion 14 coupled to and extending along the entire length of the first portion 12. An elongated first scale 16, having a substantially rectangular configuration, is coupled to the second portion 14 and includes first measurement indicia 30 to indicate predetermined lengths along the guiding device 10. For example, the predetermined lengths can be measured in millimeters, centimeters, inches, or any combination thereof. The predetermined lengths can also be set to various predetermined measurements that can vary depending on the intended uses of the guiding device 10. For example, the predetermined lengths can set forth the correct spacing on a wall between the floor and electrical outlets, light switches, door knobs, counter tops, desk/table tops, etc. The guiding device 10 may be constructed to be any suitable length in order to provide sufficient measurement capabilities as desired, such as, for example, 3 or 4 feet long. Of course, if the guiding device 10 is providing the correct spacing between elements, the guiding device 10 would be at least as long as the desired measurement.

Scale 16 can be made of various materials that are either the same as or different from the materials used in forming the first and second portions 12 and 14. Scale 16 is preferably formed of metal with the indicia 30 and with a coating applied over the metal and the indicia 30 to protect the indicia 30. This is described in more detail below with respect to FIG. 13.

Figure 3A:
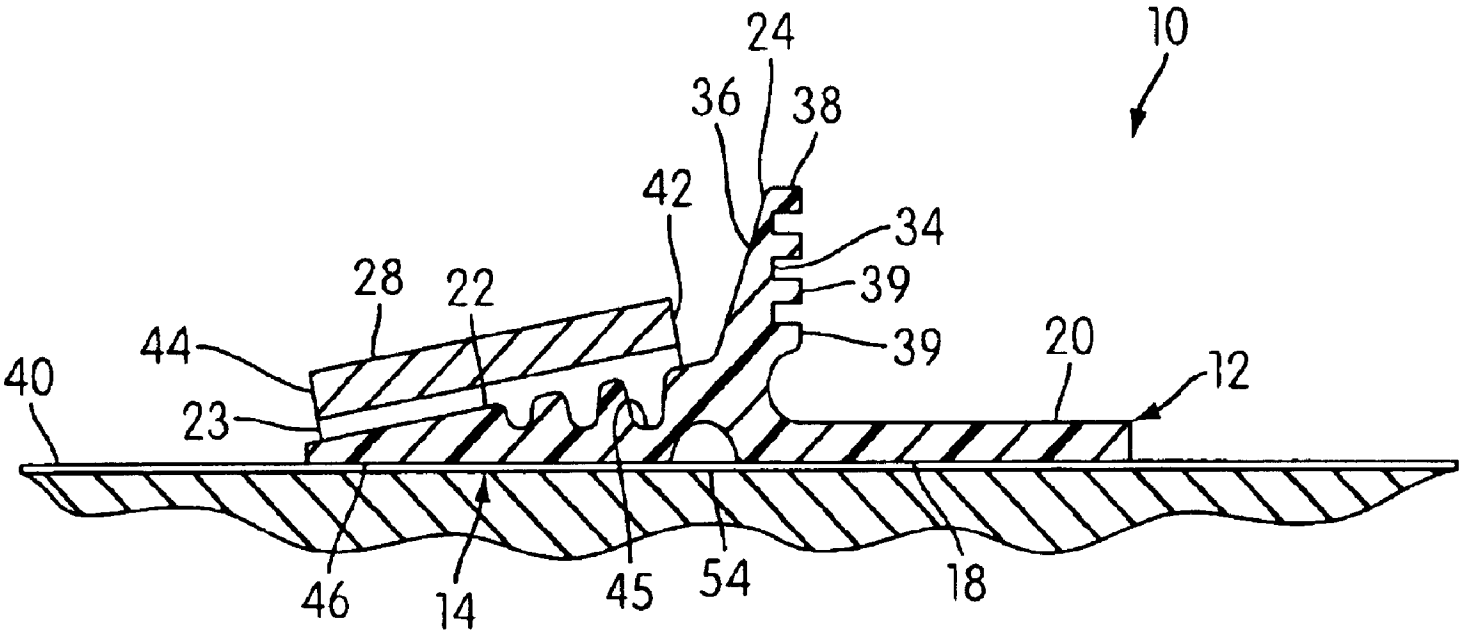
FIG. 3A is a cross-sectional view taken through the line 3—3 of FIG. 2.
Figure 3B:
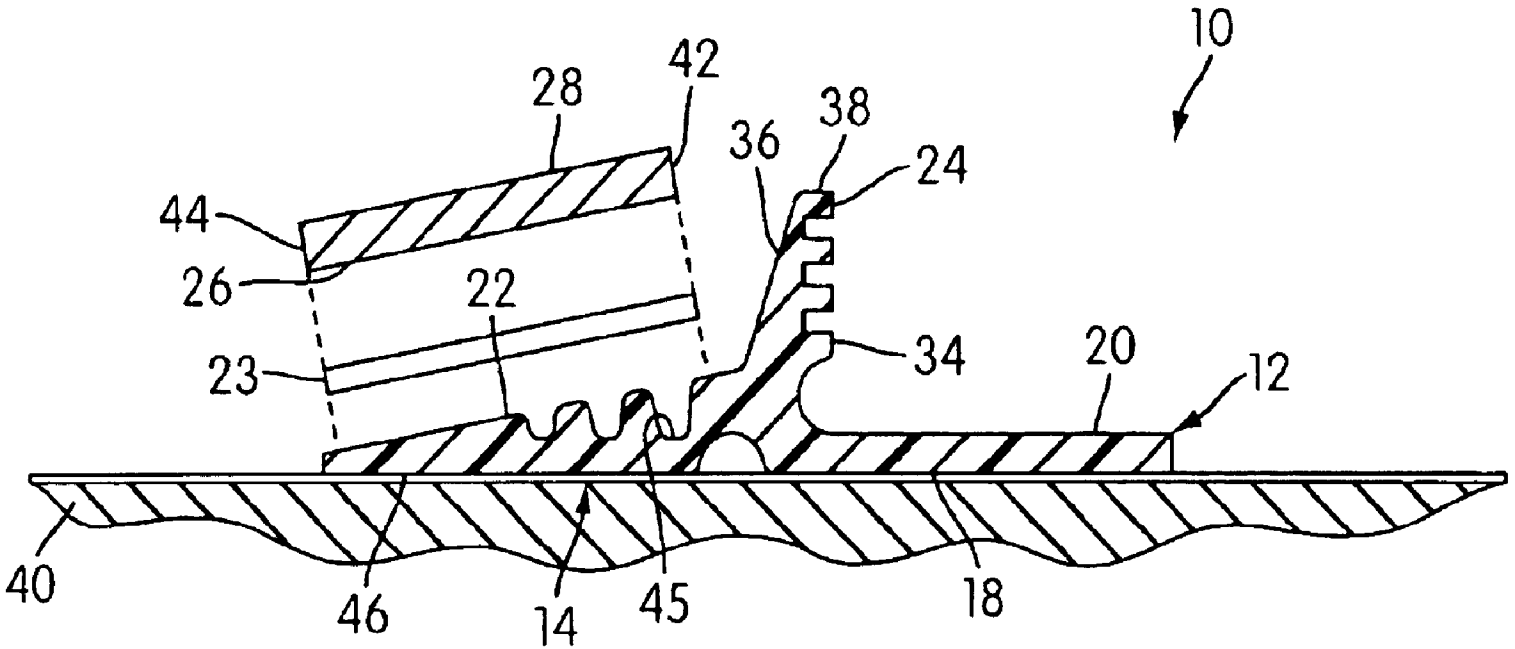
FIG. 3B is a cross-sectional view similar to FIG. 3A, but showing the scale separated from the main portion of the guiding device.

As best seen in FIGS. 3*a* and 3*b,* the elongated first portion 12 has a downwardly facing bottom surface 18 and a finger-resting surface 20 disposed opposite to the bottom surface 18. A pair of receiving openings 19 extends through the bottom surface 18 and the finger-resting surface 20. Each receiving opening 19 is configured to receive mounting structure, such as a hook, rod or other mounting or hanging element therethrough so that the guiding device 10 may be mounted, for example, in a user's garage to store the guiding device 10.

The second portion 14 has an upwardly facing scale-supporting section 22, a bottom surface 46 and an upstanding section 24, which is positioned between the scale-supporting section 22 and the first portion 12. The bottom surface 18 is substantially flat in this illustrated embodiment. The first portion 12 and the second portion 14 can be integrally formed as a unitary, one-piece element from materials such as plastic. The portions 12 and 14 can also be formed as a composite of multiple pieces and from different materials. The first and second portions 12, 14, together with the upstanding section 24, form a generally T-shaped profile of the guiding device 10. The generally T-shaped profile of the guiding device 10 allows a user to grip the guiding device 10 and hold it firmly against a working surface with minimal effort, as will be described below in greater detail, particularly with respect to FIGS. 5–9.

The upstanding section 24 is a wall projecting upwardly from the finger-resting surface 20 on a first side 34 thereof and projecting upwardly and outwardly away from the upwardly facing scale-supporting section 22 on a second side 36 thereof. Uppermost free end 38 is formed at top portions of the first and second sides 34, 36. The first side 34 extends substantially vertically and can include a plurality of ribs 39 extending outwardly in the direction of the first portion 12. The ribs 39 may provide the user with an enhanced grip during operation of the guiding device 10. As seen in FIGS. 3A–B, the second side 36 can be inclined with respect to the supporting surface 40 and the upper surface 28 of the scale 16. This incline can provide greater area around the scale 16 for the hand holding the implement.

Figure 2:
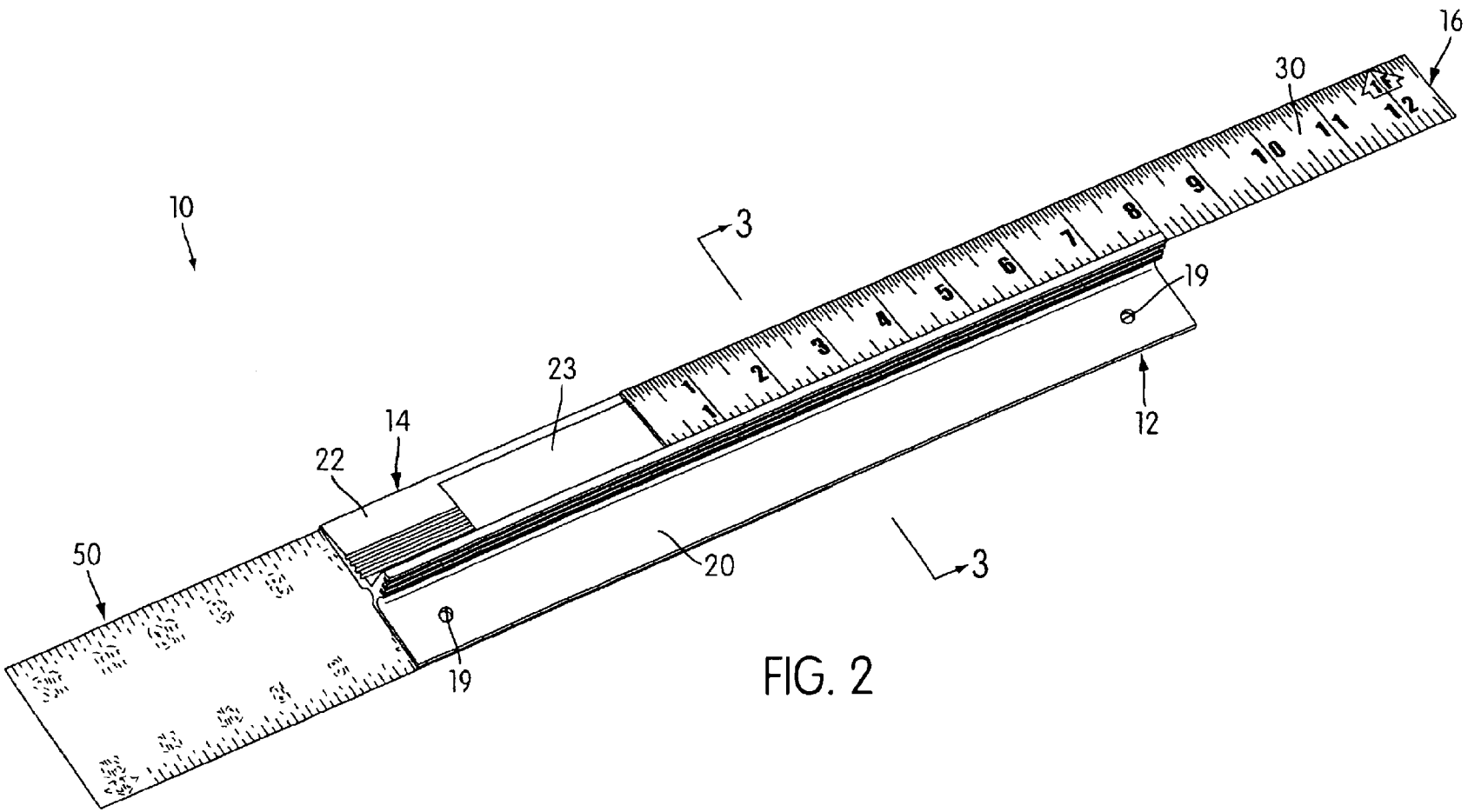
FIG. 2 is an exploded perspective view of the guiding device of FIG. 1 with the upper and lower scales and the adhesive layer laterally exploded from the main member.

As best seen in FIGS. 2 and 3A–B, the finger-resting surface 20 and the bottom surface 18 are substantially flat. The finger-resting surface 20 is substantially parallel to the bottom surface 18. The bottom surface 18 of the first portion 12 is configured to be placed against a substantially flat, working surface 40, such as a wall or floor. The bottom surfaces 18, 46 form a substantially flat contact surface 48 to permit smooth application of the guiding device 10 on a working surface 40 when the guiding device 10 is placed on the working surface 40.

FIG. 3A shows a downwardly facing scale surface 26 of the first scale 16 being rigidly attached to the scale-supporting section 22 of the second portion 14. FIG. 3B shows the downwardly facing scale surface 26 separated from the scale-supporting section 22, i.e., before the scale 16 is rigidly and nonreleasably attached to the second portion 14. Preferably, the scale 16 is attached to the scale-supporting section 22 by an adhesive or some other bonding material, such as an adhesive layer 23. The scale-supporting section 22 can include a plurality of grooves 45, as best shown in FIGS. 3A and 3B. The grooves 45 of the upwardly facing scale-supporting section 22 are optional and can be used to receive part of the adhesive 23, to aid in further fixing the scale 16 to the scale-supporting section 22.

An upwardly facing scale surface 28 of the first scale 16 is disposed opposite to the downwardly facing scale surface 26 and includes the first measurement indicia 30 (FIG. 1) to indicate predetermined lengths along the first scale 16. The upwardly facing scale surface 28 of the first scale 16 may be inclined as illustrated with respect to the working surface 40 such that the inner edge 42 of the scale 16 is further from the working surface 40 than the opposite, outer edge 44.

The upwardly facing scale surface 28 of the first scale 16 can alternatively be substantially parallel to the working surface 40 such that an inner edge 42 of the first scale 16, which is closest to the free end 38 of the upstanding section 24, is substantially the same distance from the working surface 40 than an opposite, outer edge 44 of the first scale 16.

Figure 4:
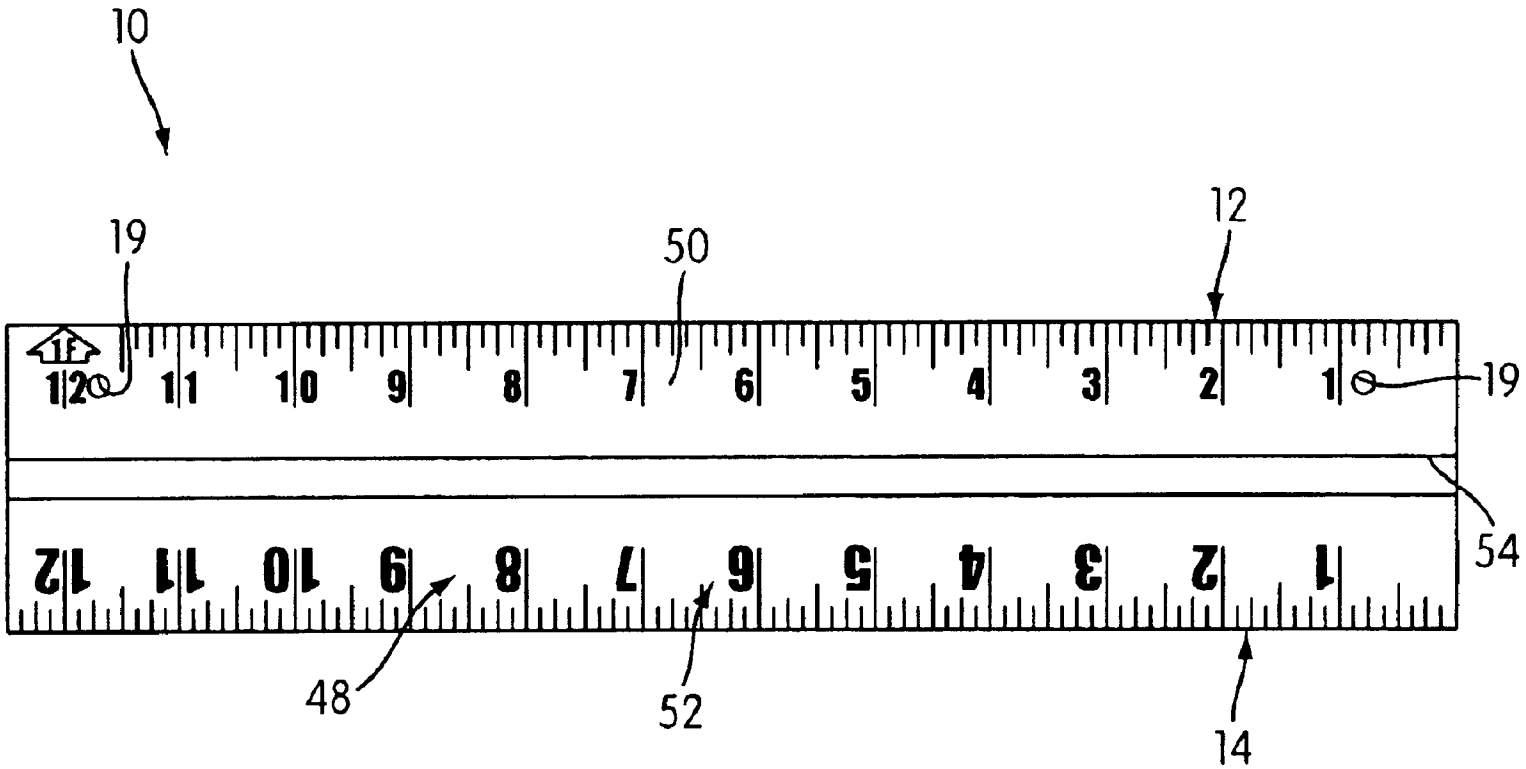
FIG. 4 is a bottom view of the guiding device of FIG. 1, showing the bottom scale.

FIG. 4 shows the contact surface 48 formed by the bottom surfaces 18, 46. The contact surface 48 can be uniform or can have recesses such as elongated recess 54, which extends lengthwise about the guiding device 10. The contact surface 48 includes a second scale 50 having second measurement indicia 52 printed on contact surface 48 to indicate predetermined lengths in the same manner as set forth above with respect to the upper scale 16. Alternatively, the second measurement indicia 52 may also be carried by or formed on an elongated, narrow strip bonded to the contact surface 48, as described below with respect to the first scale 16. Thus, it should be understood that each of the upper and lower scales can be a separate scale such as the scale 16 described above, or they can be a printed scale as the scale 50 described above. Further, guiding device 10 can be used without scales 16 and 50 and without any scales whatsoever and then used primarily as a pure straightedge merely to guide implements without providing measurement assistance.

Figure 5:
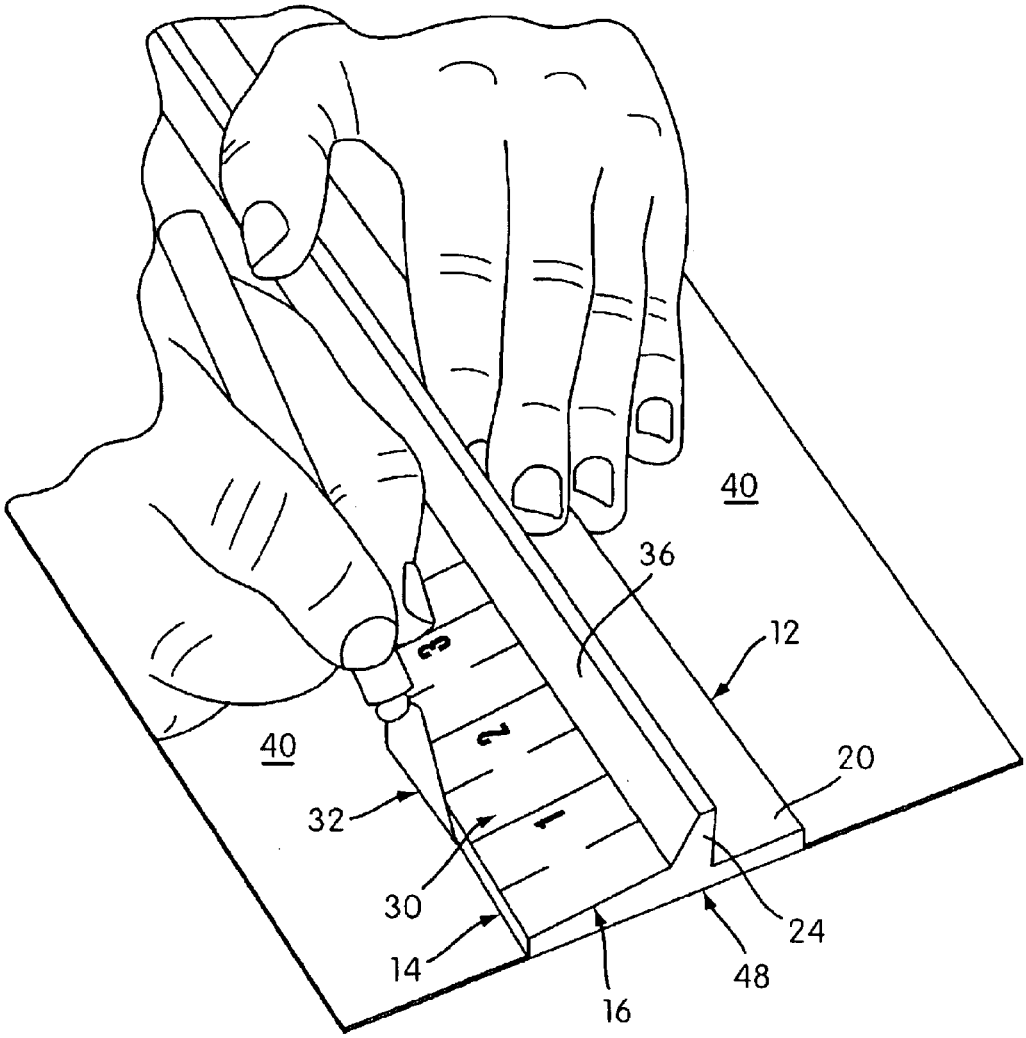
FIG. 5 is an illustrative diagram showing a user gripping the guiding device shown in FIG. 1 and moving a cutting implement along the guiding device, adjacent the first scale.
Figure 6:
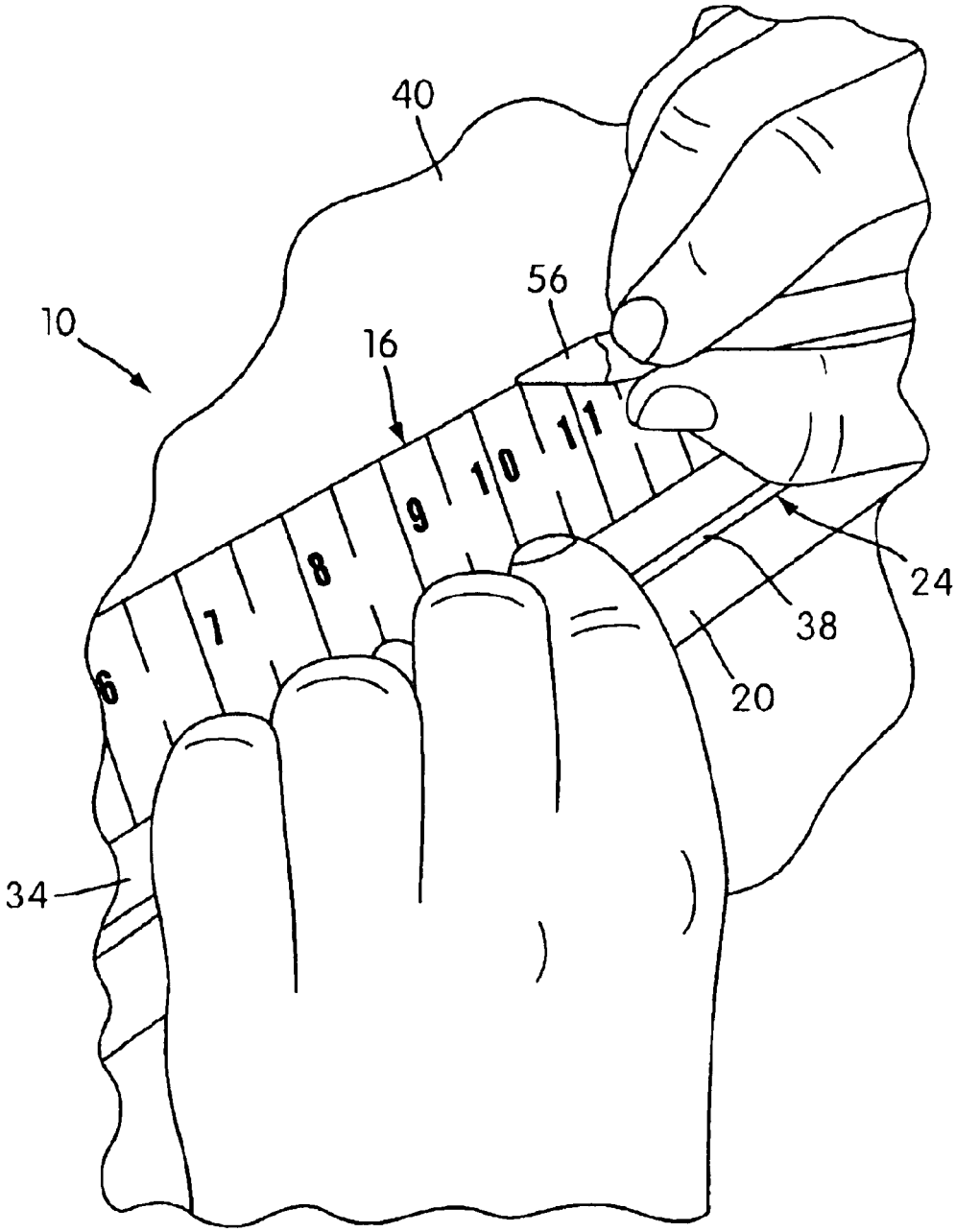
FIG. 6 is an illustrative diagram showing a user gripping the guiding device shown in FIG. 1 and moving a marking implement along the guiding device, adjacent the first scale.
Figure 8:
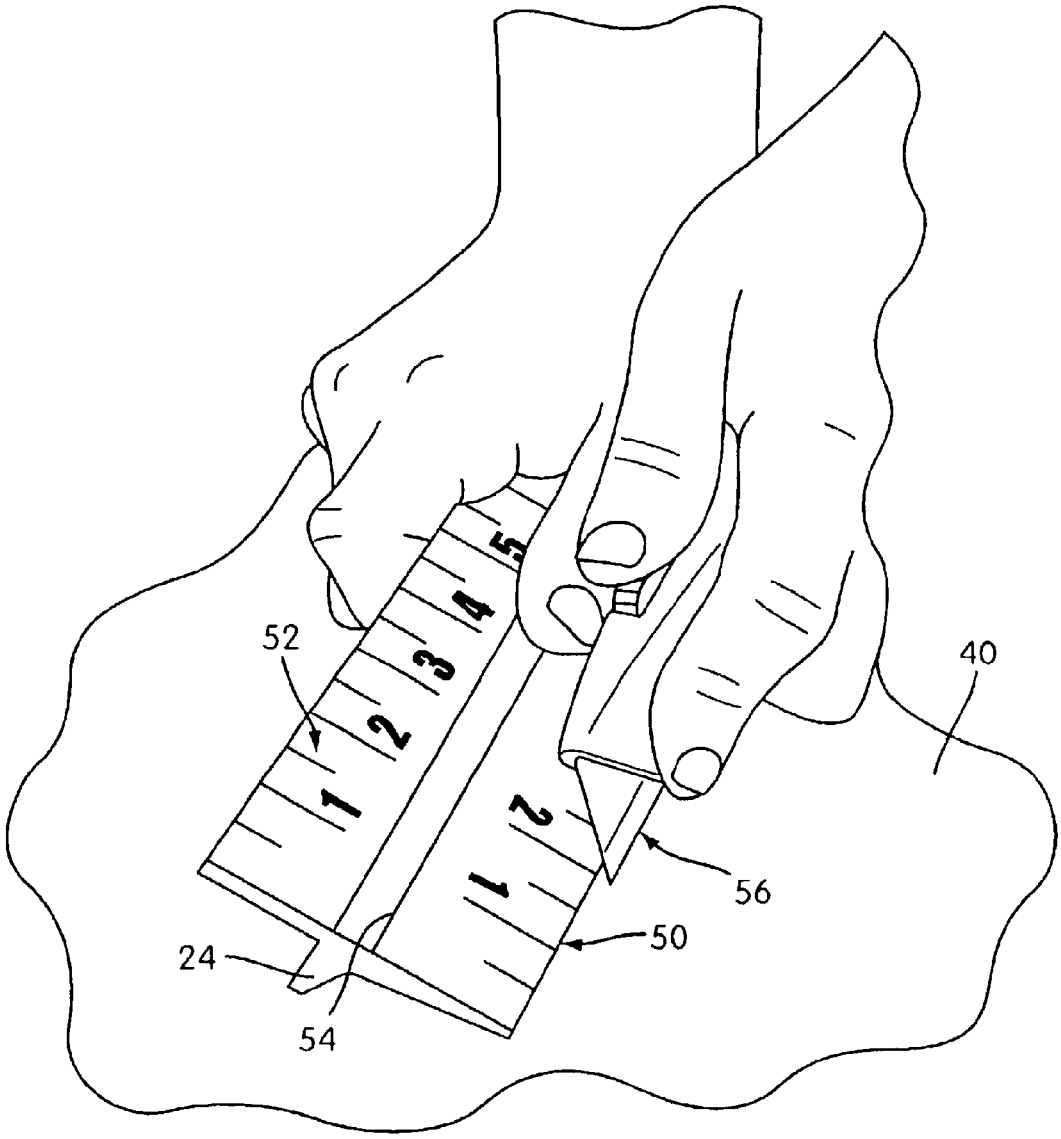
FIG. 8 is an illustrative diagram showing a user gripping the second bottom surface of the guiding device shown in FIG. 1 and moving a cutting implement along the second scale of the guiding device, adjacent the second scale thereof.
Figure 9:
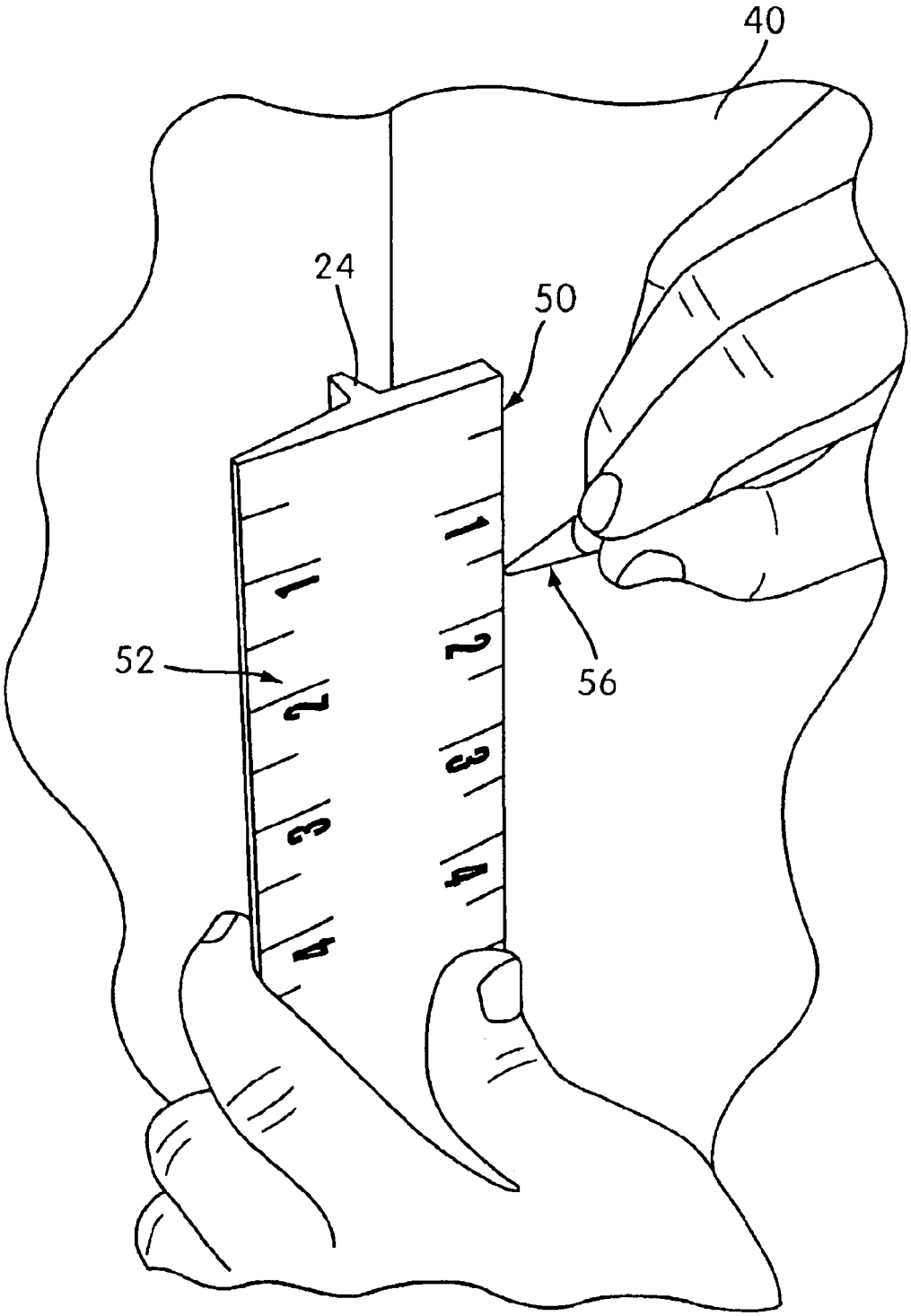
FIG. 9 is an illustrative diagram showing a user gripping the second bottom surface of the guiding device shown in FIG. 1 and moving a marking implement along the second scale of the guiding device, adjacent the second scale thereof.

As best seen in FIGS. 5, 6, 8 and 9, the finger-resting surface 20 permits fingers of a user gripping the guiding device 10 to be positioned on the finger-resting surface 20. When a user's fingers are positioned on the finger-resting surface 20, the upstanding section 24 protects the user's fingers from an implement during movement of the implement along the guiding device 10, adjacent the first scale 16. The implement may be any implement requiring guidance, such as a cutting implement 32 (FIGS. 5 and 8) or a marking implement 56 (FIGS. 6 and 9).

Various examples of a user operating the guiding device 10 are shown in FIGS. 5–9. The examples are intended as examples only and are not intended to be limiting in the numerous uses of the guiding device 10. For instance, a user may grip the guiding device 10, for example by gripping the uppermost free end 38 of the upstanding section 24 and place the contact surface 48 of the guiding device 10 against the working surface 40. As illustrated in FIG. 5, the user's fingers can be positioned on the finger-resting surface 20 while being protected from the cutting implement 32, which may be a knife or some other cutting device, by the upstanding section 24 during movement of the cutting implement 32 along the guiding device 10, adjacent the first scale 16. Alternatively, as shown in FIG. 6, the user may use a marking implement 56, such as a pencil, to mark positions on the working surface 40.

Figure 7:
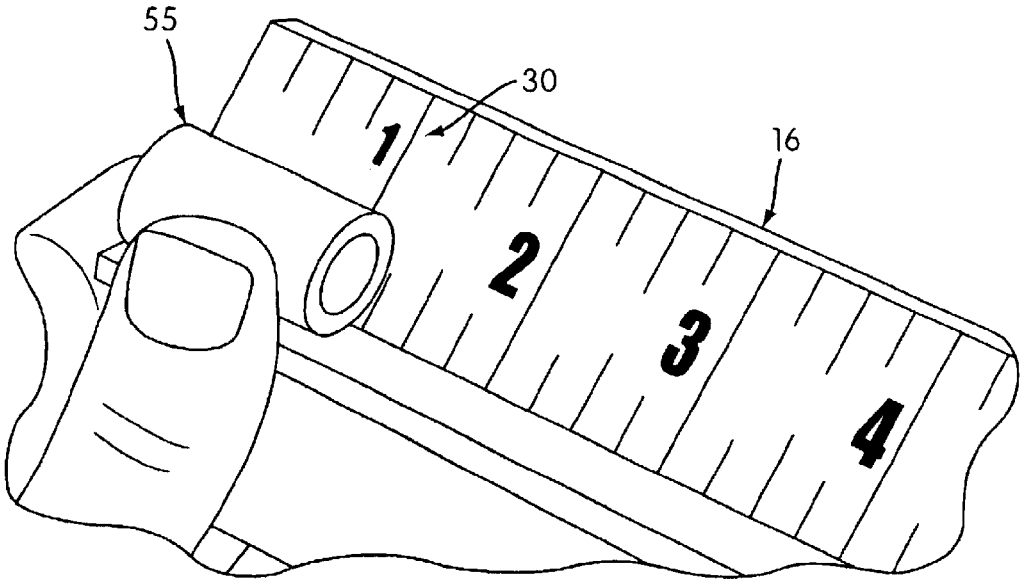
FIG. 7 is an illustrative diagram showing a user measuring a small implement using the first scale of the guiding device shown in FIG. 1.

FIG. 7 shows a user measuring an object 55, such as a socket, nail, or any other small object, by placing the object against the first scale 16 of the guiding device 10 and reading the first measurement indicia 30.

As shown in FIGS. 8 and 9, a user may grip the second bottom surface 46 of the guiding device 10, instead of the uppermost free end 38 of the upstanding section 24, to use the second scale 50. As shown in FIGS. 5 and 8, the user may position his/her thumb in the elongated recess 54 formed in the contact surface 48 for better control over the guiding device 10. The user can then move the cutting implement 32, for example, along the guiding device 10, adjacent the second scale 50 and read the second measurement indicia 52 printed on the second scale 50. Alternatively, as shown in FIGS. 6 and 9, the user may use the marking implement 56 to mark positions on the working surface 40 along the guiding device 10, adjacent the second scale 50.

Figure 10:
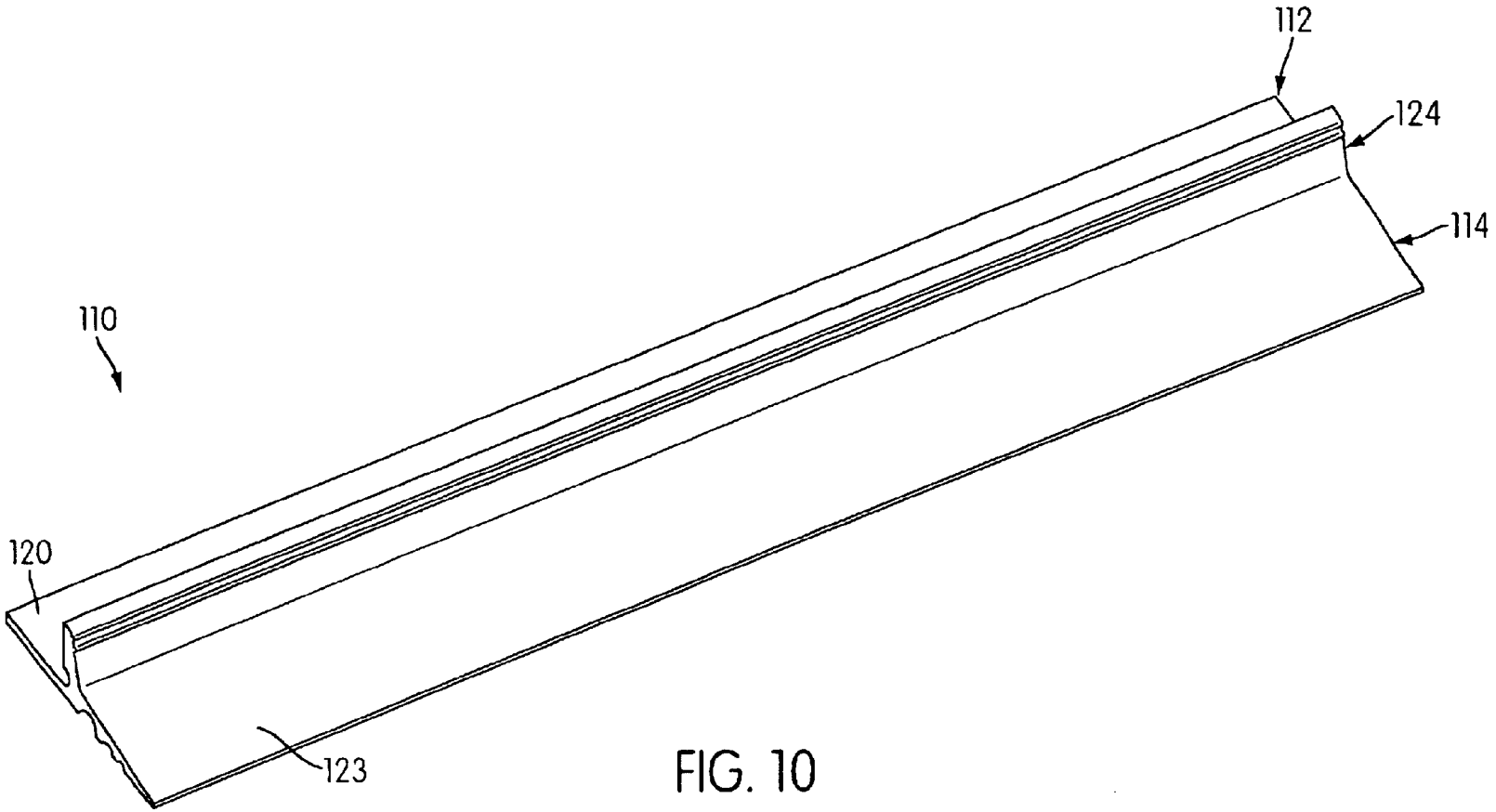
FIG. 10 is a perspective view of an alternative embodiment of the guiding device shown in FIG. 1, but without the top scale.
Figure 11:
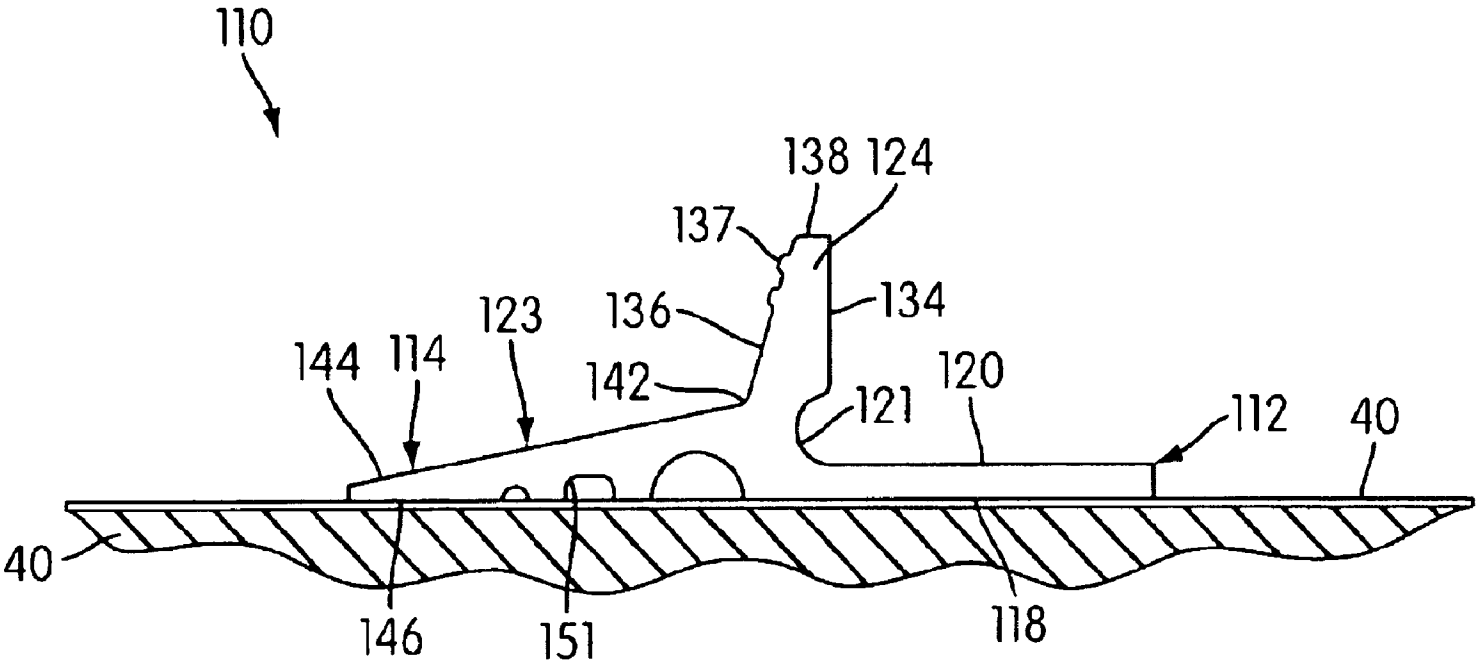
FIG. 11 is a side view of the device of FIG. 10.
Figure 12:
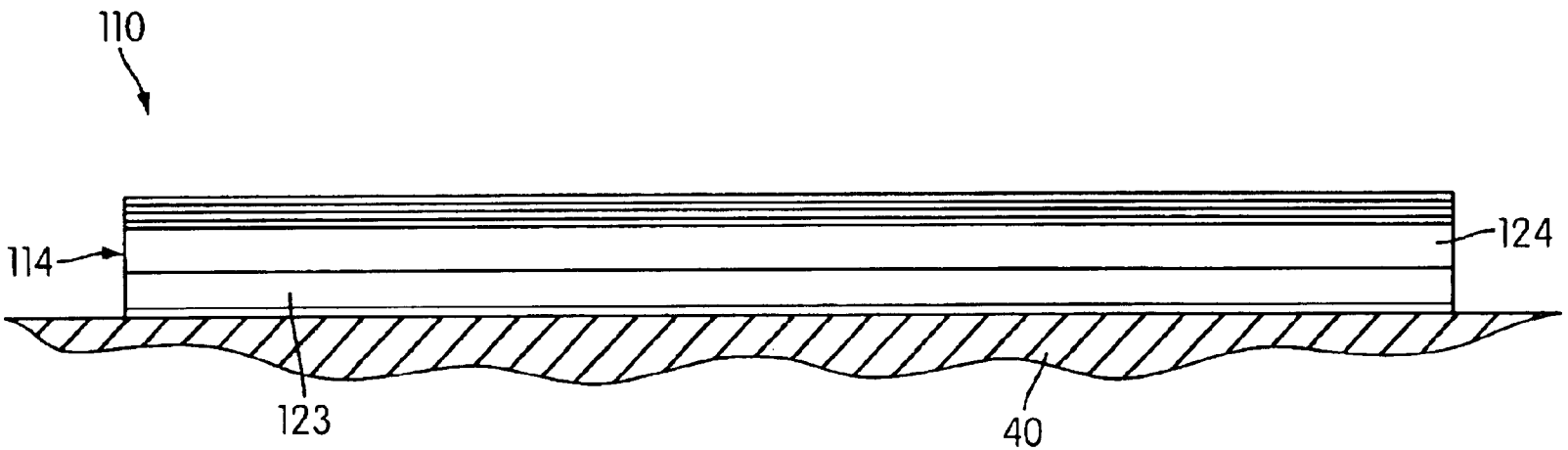
FIG. 12 is a front view showing an upstanding section and an inclined section of the guiding device shown in FIG. 10.

FIGS. 10–12 show a guiding device 110, which is an alternative embodiment of the guiding device 10. Elements in the guiding device 110 that are similar to elements of the guiding device 10 have corresponding reference numerals. For simplicity the scale 16 is omitted from the figures. However, scale 16 and scale 50 can employed in a substantially identical manner as set forth above with respect to guiding device 10.

The guiding device 110 comprises an elongated first portion 112 and an elongated second portion 114 coupled to and extending along the entire length of the first portion 112. A first scale 16 (not shown) can be coupled to the elongated second portion 114.

The elongated first portion 112 has a downwardly facing bottom surface 118 and a finger-resting surface 120 opposite to the bottom surface 118, of which both are each substantially flat. The finger-resting surface 120 is substantially parallel to the bottom surface 118. The bottom surface 118 lies in a first plane, which is defined by the working surface 140 in FIG. 11.

The elongated, second portion 114 has an inclined scale-supporting section 123 and an upstanding section 124, which is positioned between the inclined scale-supporting section 123 and the first portion 112. The second portion 114 also includes a downwardly facing bottom surface 146 that is substantially flat and lies in the first plane. As best seen in FIG. 11, the first portion 112 and the second portion 114 can be integrally formed as a unitary, one-piece plastic element that together with the upstanding section 124 forms a generally T-shaped cross section of the guiding device 110.

The upstanding section 124 is a wall projecting upwardly from the finger-resting surface 120 on a first side 134 thereof and projecting upwardly and outwardly from the inclined scale-supporting section 123 on a second side 136 thereof. An annular cut-out portion 121 is interposed between the first side 234 and the finger-resting surface 220 and may be configured to be grasped by a user or to store the guiding device 210, for example. The second side 136 includes a plurality of projections 137 that may provide the user with an enhanced grip during operation of the guiding device 110. A substantially planar uppermost free end 138 is formed at top portions of the first and second sides 134, 136.

The inclined scale-supporting section 123 is inclined with respect to the first plane such that an innermost part 142 of the inclined scale-supporting section 123, which is adjacent the free end 138 of the upstanding section 124, is positioned further from the first plane than an opposite, outermost part 144 of the inclined scale-supporting section 123, as best seen in FIG. 11. The inclined scale-supporting section 123 includes a plurality of elongated recesses 154 formed in the inclined scale-supporting section 123 and each extend the entire length of the guiding device 110 in the longitudinal direction thereof, similar to recess 54 of the guiding device 10 and shown in FIG. 4.

A first indicia is not shown, but can be substantially identical to the first measurement indicia 30, and can be coupled to the inclined scale-supporting section 123 to indicate predetermined lengths along the guiding device 110. The first indicia 30 can be located on a first scale, such as the first scale 16, that is bonded or adhered, for example, to the inclined scale-supporting section 123. Alternatively, the first indicia 30 may be printed onto the inclined scale-supporting section 123.

Similarly, a second indicia (not shown, but substantially identical to the second measurement indicia 52, is coupled to one of the bottom surfaces 118, 146 to indicate predetermined lengths along the guiding device 110. The second indicia can be located on a first scale, such as the first scale 16, that is bonded or adhered, for example, to one of the bottom surfaces 118, 146. Alternatively, the second indicia may be printed onto one of the bottom surfaces 118, 146 or one of the sides 134, 136, for example.

The finger-resting surface 120 permits fingers of a user gripping the guiding device 110 to be positioned on the finger-resting surface 120 while being protected from an implement, such as implements 32 or 56, by the upstanding section 124 during movement of the implement along the guiding device 110, adjacent the inclined scale-supporting section 123.

As best seen in FIGS. 5–9 and described above, the operation of the guiding device 10 is sufficient to provide an understanding of the operation of the guiding device 110.

Figure 13:
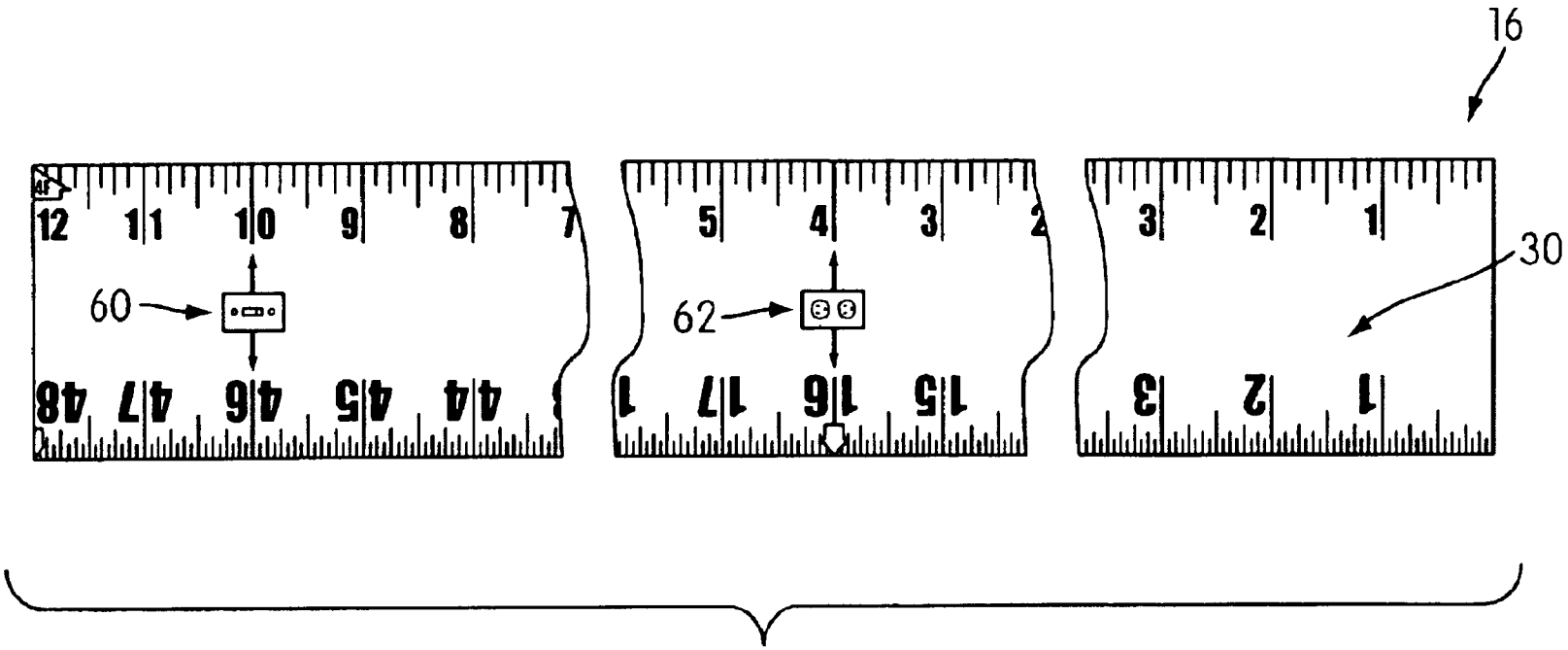
FIG. 13 is a partial bottom view of the second scale shown in FIG. 2.

FIG. 13 shows the first scale 16, which is an elongated, narrow strip, may be made of metal, for example, and coated with a non-metallic material, such as Mylar® or Nylon®, to protect the first measurement indicia 30 when the first scale 16 is coupled to the guiding device 10. Additionally, the first scale 16 can be coated by heat sealing a polyester film over the elongated narrow strip of the scale 16 or with lacquer, for example by using acrylic paint to provide a transparent coating.

The first measurement indicia 30 may include standard measurement indicators which provide a user with a standard measurement of some kind, for example, heights of electrical outlets, light switches, door knobs, counter, desk or table tops, or any other standard measurement known in the art. A graphic representation of each standard measurement may be shown on the first measurement indicia 30 (the graphic representations of the height for a light switch and an electrical outlet are indicated at 60, 62, respectively, and shown in FIG. 13).

The first scale 16 may include the first measurement indicia 30 as well as the first indicia used in the guiding device 110 and can be coupled to either the guiding device 10 or the guiding device 110, as described above. Since the construction and operation of the first scale 16 is identical in both of the guiding devices 10, 110, a description of the first scale 16 with respect to the guiding device 10 will be sufficient to provide an understanding for implementations in each of the guiding devices 10, 110.

Other embodiments of the present invention will now be described below. In the descriptions of the further embodiments, only the points of difference of each embodiment from the second embodiment illustrated in FIGS. 10–12 will be described. That is, in these embodiments, the constituent parts the same as those in the first embodiment are referenced correspondingly in the drawings and the description about them will be omitted. FIGS. 14–27 are illustrative diagrams showing different alternative embodiments of the guiding devices 10, 110. As with the description of guiding device 110, the upper and lower scales are not shown for simplicity, although the use of one or both the upper and lower scales 16 and 50 can be employed on any and all of the embodiments disclosed herein. Optionally, the guiding devices illustrated herein throughout this disclosure can be used without scales, if desired.

Figure 14:
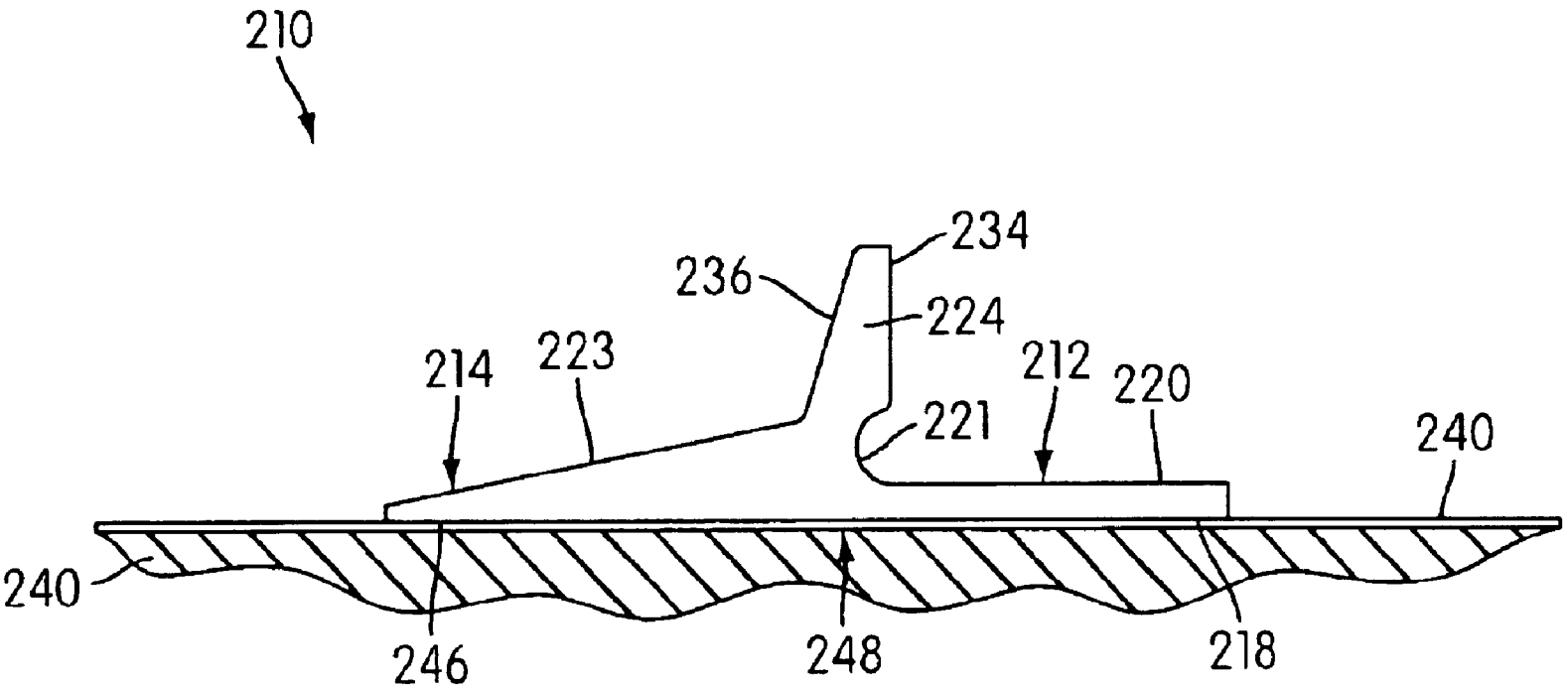
FIGS. 14–27 are illustrative diagrams showing examples of different alternative embodiments of the main portions of the guiding device shown in FIGS. 1 but without the upper scales.

FIG. 14 shows a profile for a guiding device 210 comprising an elongated first portion 212 and an elongated second portion 214 coupled to and extending along the entire length of the first portion 212.

The elongated first portion 212 has a generally rectangular shaped cross sectional profile with a downwardly facing bottom surface 218 and a finger-resting surface 220 disposed opposite to the bottom surface 218. The second portion 214 has a generally rectangular shaped cross sectional profile with an upwardly facing scale-supporting section 223, a bottom surface 246 and an upstanding section 224, which is positioned between the scale-supporting section 223 and the first portion 212. The bottom surface 246 is substantially identical to the bottom surface 146, but is substantially flat rather than having recesses formed therein. The bottom surfaces 218, 246 and the finger-resting surface 220 are substantially flat and the finger-resting surface 220 is substantially parallel to the bottom surface 218.

The upstanding section 224 is a wall projecting upwardly from the finger-resting surface 220 on a flat first side 234 thereof and projecting upwardly and outwardly away from the upwardly facing scale-supporting section 223 on a flat second side 236 thereof. A substantially planar uppermost free end 238 is formed at top portions of the first and second sides 234, 236. The first side 234 extends substantially vertically. An annular cut-out portion 221 is interposed between the first side 234 and the finger-resting surface 220 and may be configured to be grasped by a user or to store the guiding device 210, for example. The upstanding section 224 is substantially identical to the upstanding section 124, except that the second side 236 is flat and does not include recesses therein or projections extending therefrom.

The inclined scale-supporting section 223 is inclined with respect to the working surface 240 such that an inner end 241 thereof, which is closest to the free end 238 of the upstanding section 224, is further from the working surface 240 than an opposite, outer end 243 thereof. The outermost part 227 of the inclined scale-supporting section 223 is inclined at a steeper angle (sloping downwardly toward an outermost part 227 of the inclined scale-supporting section 223) than the innermost part 225 of the inclined scale-supporting section 223, which is adjacent the upstanding section 224.

The bottom surface 218 of the first portion 212 is configured to be placed against a substantially flat, working surface 240, such as a wall or floor, and the bottom surfaces 218, 246 form a substantially flat contact surface 248 to permit smooth application of the guiding device 210 on a working surface 240 when the guiding device 210 is placed on the working surface 240.

The scale 16 can be rigidly attached to the second portion 214, for example, bonded to the inclined scale-supporting section 223, to indicate predetermined lengths along the guiding device 210.

Figure 15:
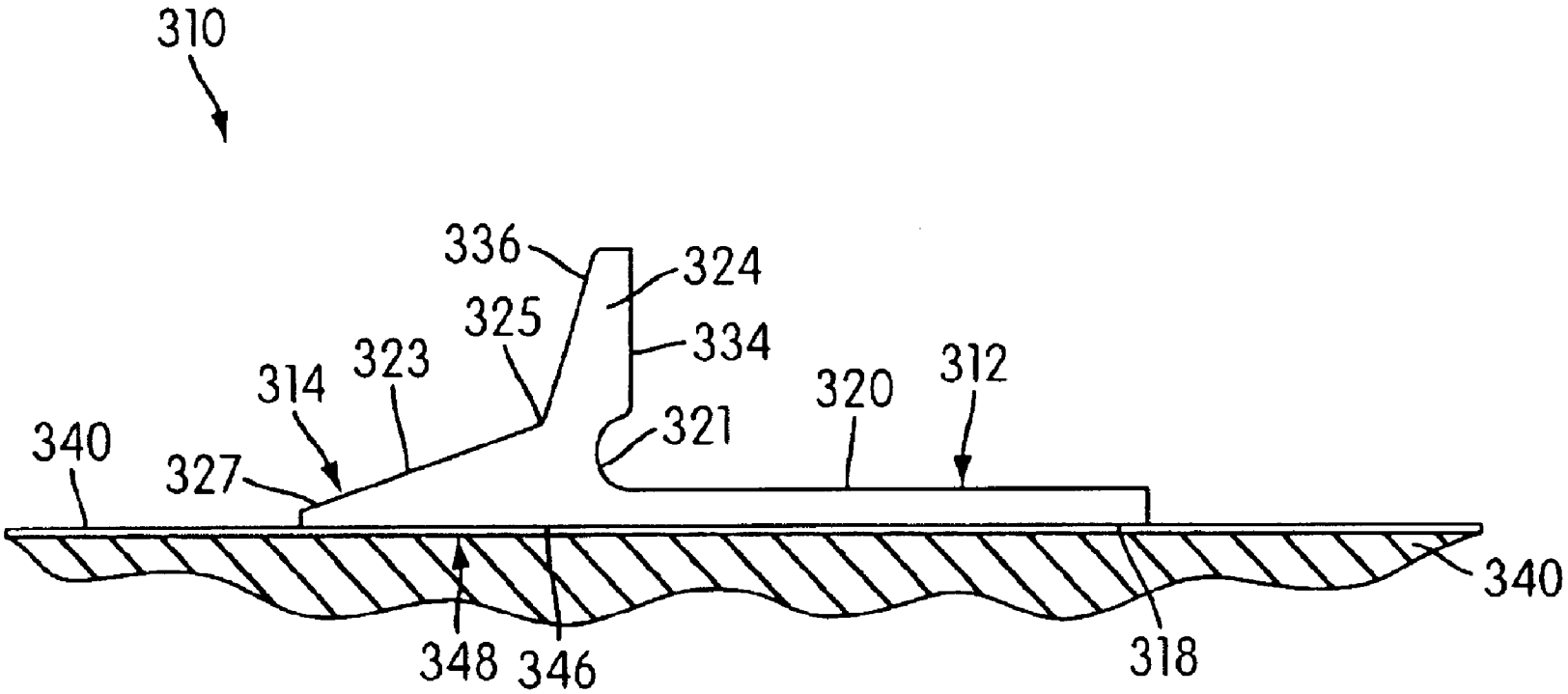

FIG. 15 shows a profile for a guiding device 310 comprising an elongated first portion 312 and an elongated second portion 314 coupled to and extending along the entire length of the first portion 312. The first portion 312 is substantially identical to the first portion 212, but is wider.

The elongated first portion 312 has a generally rectangular shaped cross sectional profile with a downwardly facing bottom surface 318 and a finger-resting surface 320 disposed opposite to the bottom surface 318. The second portion 314 has a generally rectangular shaped cross sectional profile with an upwardly facing scale-supporting section 323, a bottom surface 346 and an upstanding section 324, which is positioned between the scale-supporting section 323 and the first portion 312. The bottom surfaces 318, 346 and the finger-resting surface 320 are substantially flat and the finger-resting surface 320 is substantially parallel to the bottom surface 318.

The upstanding section 324 is a wall projecting upwardly from the finger-resting surface 320 on a first side 334 thereof and projecting upwardly and outwardly away from the upwardly facing scale-supporting section 323 on a second side 336 thereof. A substantially planar uppermost free end 338 is formed at top portions of the first and second sides 334, 336. The first side 334 extends substantially vertically. An annular cut-out portion 321 is interposed between the first side 334 and the finger-resting surface 320 and may be configured to be grasped by a user or to store the guiding device 210, for example.

The inclined scale-supporting section 323 is inclined with respect to the working surface 340 such that an inner part 325 thereof, which is closest to the free end 338 of the upstanding section 324, is further from the working surface 340 than an opposite, outer part 327 thereof. The outermost part 327 of the inclined scale-supporting section 323 is inclined at a steeper angle (sloping downwardly toward an outermost part 327 of the inclined scale-supporting section 323) than the innermost part 325 of the inclined scale-supporting section 323, which is adjacent the upstanding section 324.

The upstanding section 324 is substantially identical to the upstanding section 224. Due to the wide first portion 312, the upstanding section 324 is positioned closer to the outermost part 327 of the inclined scale-supporting section 323 than the upstanding section 224 is positioned with respect to the outermost part 227 of the inclined scale-supporting section 223.

The bottom surface 318 of the first portion 312 is configured to be placed against a substantially flat, working surface 340, such as a wall or floor, and the bottom surfaces 318, 346 form a substantially flat contact surface 348 to permit smooth application of the guiding device 310 on a working surface 340 when the guiding device 310 is placed on the working surface 340.

The scale 16 can be rigidly attached to the second portion 314, for example, bonded to the inclined scale-supporting surface 323, to indicate predetermined lengths along the guiding device 310.

Figure 16:
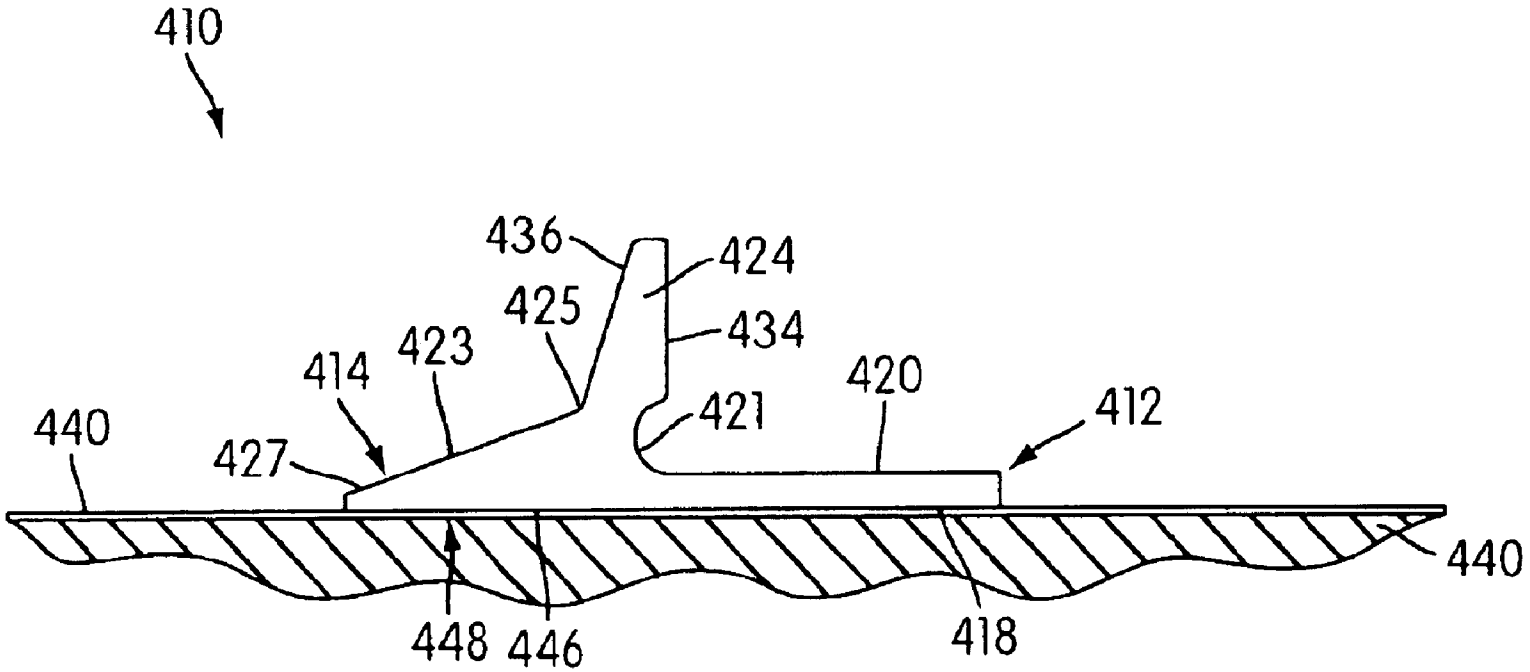

FIG. 16 shows a profile for a guiding device 410 comprising an elongated first portion 412 and an elongated second portion 414 coupled to and extending along the entire length of the first portion 412.

The elongated first portion 412 has a generally rectangular shaped cross sectional profile with a downwardly facing bottom surface 418 and a finger-resting surface 420 disposed opposite to the bottom surface 418. The elongated first portion 412 is substantially identical to the elongated first portion 212. The second portion 414 has a generally rectangular shaped cross sectional profile with an upwardly facing scale-supporting section 423, a bottom surface 446 and an upstanding section 424, which is positioned between the scale-supporting section 423 and the first portion 412. The bottom surfaces 418, 446 and the finger-resting surface 420 are substantially flat and the finger-resting surface 420 is substantially parallel to the bottom surface 418.

The upstanding section 424, which is substantially identical to the upstanding section 324, is a wall projecting upwardly from the finger-resting surface 420 on a first side 434 thereof and projecting upwardly and outwardly away from the upwardly facing scale-supporting section 423 on a second side 436 thereof. A substantially planar uppermost free end 438 is formed at top portions of the first and second sides 434, 436. The first side 434 extends substantially vertically. An annular cut-out portion 421 is interposed between the first side 334 and the finger-resting surface 320 and may be configured to be grasped by a user or to store the guiding device 210, for example.

The inclined scale-supporting section 423 is inclined with respect to the working surface 440 such that an inner part 425 thereof, which is closest to the free end 438 of the upstanding section 424, is further from the working surface 440 than an opposite, outer part 427 thereof. The outermost part 427 of the inclined scale-supporting section 423 is inclined at a steeper angle (sloping downwardly toward an outermost part 427 of the inclined scale-supporting section 423) than the innermost part 425 of the inclined scale-supporting section 423, which is adjacent the upstanding section 424.

The bottom surface 418 of the first portion 412 is configured to be placed against a substantially flat, working surface 440, such as a wall or floor, and the bottom surfaces 418, 446 form a substantially flat contact surface 448 to permit smooth application of the guiding device 410 on a working surface 440 when the guiding device 410 is placed on the working surface 440.

The scale 16 can be rigidly attached to the second portion 414, for example, bonded to the inclined scale-supporting surface 423, to indicate predetermined lengths along the guiding device 410.

Figure 17:
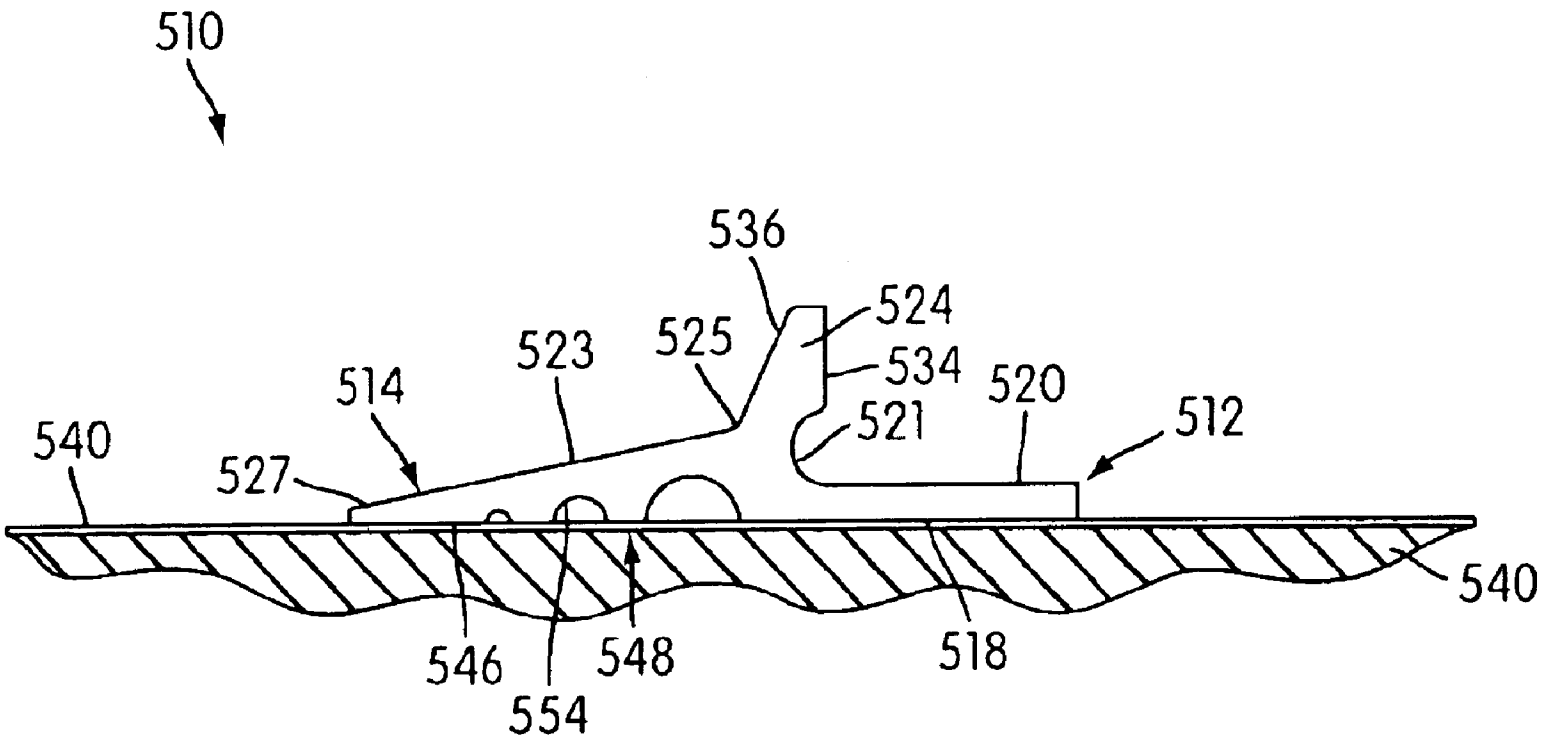

FIG. 17 shows a profile for a guiding device 510 comprising an elongated first portion 512 and an elongated second portion 514 coupled to and extending along the entire length of the first portion 512.

The elongated first portion 512 has a generally rectangular shaped cross sectional profile with a downwardly facing bottom surface 518 and a finger-resting surface 520 disposed opposite to the bottom surface 518. The second portion 514 has a generally rectangular shaped cross sectional profile with an upwardly facing scale-supporting section 523, a bottom surface 546 and an upstanding section 524, which is positioned between the scale-supporting section 523 and the first portion 512. The bottom surface 518 and the finger-resting surface 520 are substantially flat and the finger-resting surface 520 is substantially parallel to the bottom surface 518. The bottom surface 546 includes a plurality of elongated recesses 554 is formed therein, each of which extending the entire length of the guiding device 510 in the longitudinal direction thereof.

The upstanding section 524 is a wall projecting upwardly from the finger-resting surface 520 on a first side 534 thereof and projecting upwardly and outwardly away from the upwardly facing scale-supporting section 523 on a second side 536 thereof. A substantially planar uppermost free end 538 is formed at top portions of the first and second sides 534, 536. The first side 534 extends substantially vertically. An annular cut-out portion 521 is interposed between the first side 534 and the finger-resting surface 520 and may be configured to be grasped by a user or to store the guiding device 510, for example.

The inclined scale-supporting section 523 is inclined with respect to the working surface 540 such that an inner part 525 thereof, which is closest to the free end 538 of the upstanding section 524, is further from the working surface 540 than an opposite, outer part 527 thereof. The outer part 527 of the inclined scale-supporting section 523 is inclined at a steeper angle (sloping downwardly toward the outermost part 527 of the inclined scale-supporting section 523) than the innermost part 525 of the inclined scale-supporting section 523, which is adjacent the upstanding section 524.

The bottom surface 518 of the first portion 512 is configured to be placed against a substantially flat, working surface 540, such as a wall or floor, and the bottom surfaces 518, 546 form a substantially flat contact surface 548 to permit smooth application of the guiding device 510 on a working surface 540 when the guiding device 510 is placed on the working surface 540.

The scale 16 can be rigidly attached to the second portion 214, for example, bonded to the inclined scale-supporting section 223, to indicate predetermined lengths along the guiding device 210.

Figure 18:
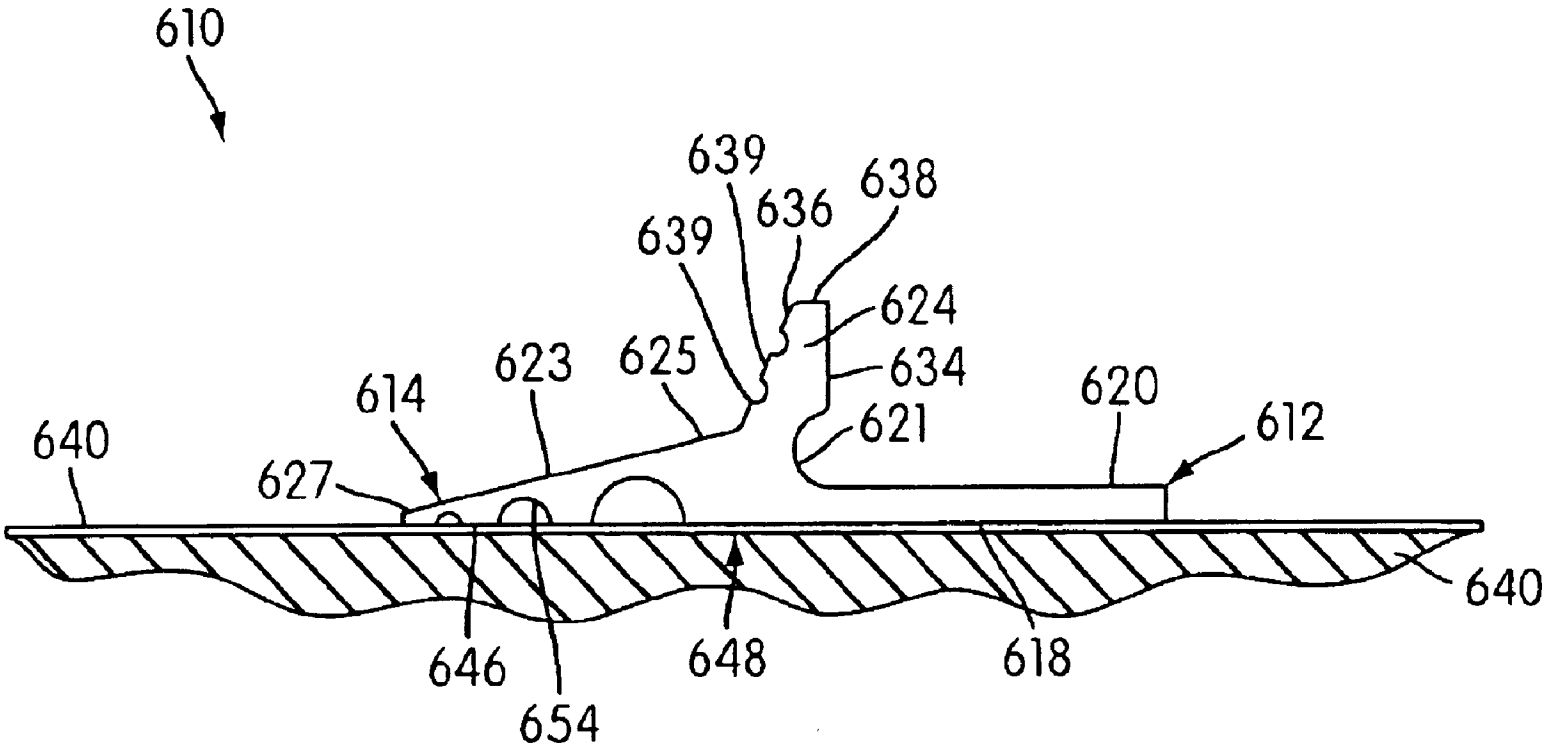

FIG. 18 shows a profile for a guiding device 610 comprising an elongated first portion 612 and an elongated second portion 614 coupled to and extending along the entire length of the first portion 612.

The elongated first portion 612 has a generally rectangular shaped cross sectional profile with a downwardly facing bottom surface 618 and a finger-resting surface 620 disposed opposite to the bottom surface 618. The second portion 614 has a generally rectangular shaped cross sectional profile with an upwardly facing scale-supporting section 623, a bottom surface 646 and an upstanding section 624, which is positioned between the scale-supporting section 623 and the first portion 612. The bottom surfaces 618, 646 and the finger-resting surface 620 are substantially flat and the finger-resting surface 620 is substantially parallel to the bottom surface 618.

The upstanding section 624 is a wall projecting upwardly from the finger-resting surface 620 on a first side 634 thereof and projecting upwardly and outwardly away from the upwardly facing scale-supporting section 623 on a second side 636 thereof. A substantially planar uppermost free end 638 is formed at top portions of the first and second sides 634, 636. The first side 34 extends substantially vertically. The upstanding section 624 is substantially identical to the upstanding section 524, but the second side 636 thereof includes a plurality of ribs 639 extending outwardly in the direction of the second portion 614. The ribs 639 may provide the user with an enhanced grip during operation of the guiding device 610.

The inclined scale-supporting section 623 is inclined with respect to the working surface 640 such that an inner end 645 thereof, which is closest to the free end 638 of the upstanding section 624, is further from the working surface 640 than an opposite, outer end 647 thereof. The outermost part 627 of the scale-supporting section 623 is inclined at a steeper angle (sloping downwardly toward an outermost part 627 of the inclined scale-supporting section 623) than an innermost part 625 of the inclined scale-supporting section 623, which is adjacent the upstanding section 624.

The bottom surface 618 of the first portion 612 is configured to be placed against a substantially flat, working surface 640, such as a wall or floor, and the bottom surfaces 618, 646 form a substantially flat contact surface 648 to permit smooth application of the guiding device 610 on a working surface 640 when the guiding device 610 is placed on the working surface 640.

The scale 16 can be rigidly attached to the second portion 214, for example, bonded to the inclined scale-supporting section 223, to indicate predetermined lengths along the guiding device 210.

Figure 19:
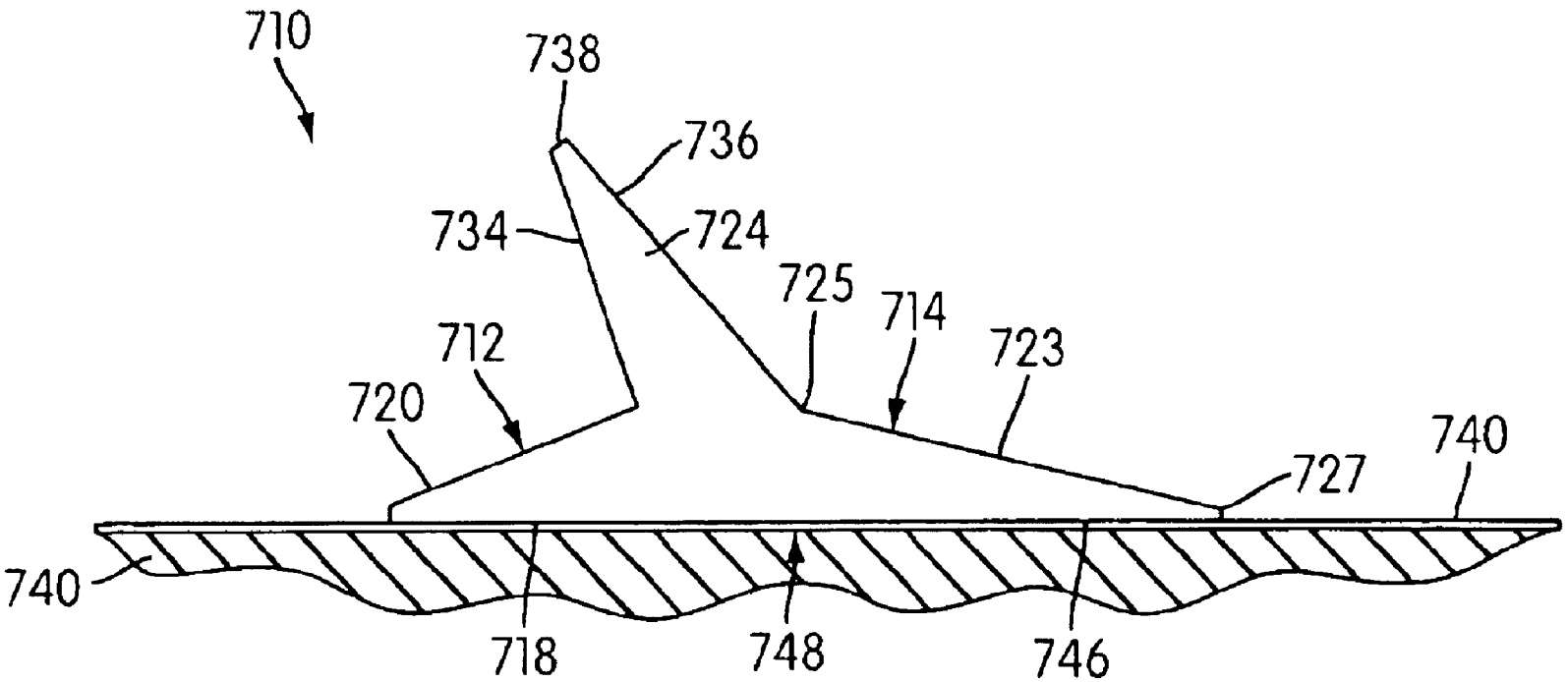

FIG. 19 shows a profile for a guiding device 710 comprising an elongated first portion 712 and an elongated second portion 714 coupled to and extending along the entire length of the first portion 712.

The elongated first portion 712 has a downwardly facing bottom surface 718 and a finger-resting surface 720 disposed opposite to the bottom surface 718. The second portion 714 has an upwardly facing scale-supporting section 723, a bottom surface 746 and an upstanding section 724, which is positioned between the scale-supporting section 723 and the first portion 712. The finger-resting surface 720 and the scale-supporting surface 714 are inclined with respect to supporting surface 740.

The upstanding section 724 is a wall projecting upwardly and toward the finger-resting surface 720 on a first side 734 thereof and projecting upwardly and away from the upwardly facing scale-supporting section 723 on a second side 736 thereof. A rounded uppermost free end 738 is formed at top portions of the first and second sides 734, 736.

The inclined scale-supporting section 723 is inclined with respect to the working surface 740 such that an inner part 725 thereof, which is closest to the free end 738 of the upstanding section 724, is further from the working surface 740 than an opposite, outer part 727 thereof. The first and second sides 734, 736 are inclined toward the outermost part 727 of the inclined scale-supporting section 723 such that the first side 734 and the finger-resting portion 720 forms an acute angle and the second side 736 and the inclined scale-supporting section 723 forms an obtuse angle.

The bottom surface 718 of the first portion 712 is configured to be placed against a substantially flat, working surface 740, such as a wall or floor, and the bottom surfaces 718, 746 form a substantially flat contact surface 748 to permit smooth application of the guiding device 710 on a working surface 740 when the guiding device 710 is placed on the working surface 740.

The scale 16 can be rigidly attached to the second portion 214, for example, bonded to the inclined scale-supporting section 223, to indicate predetermined lengths along the guiding device 210.

Figure 20:
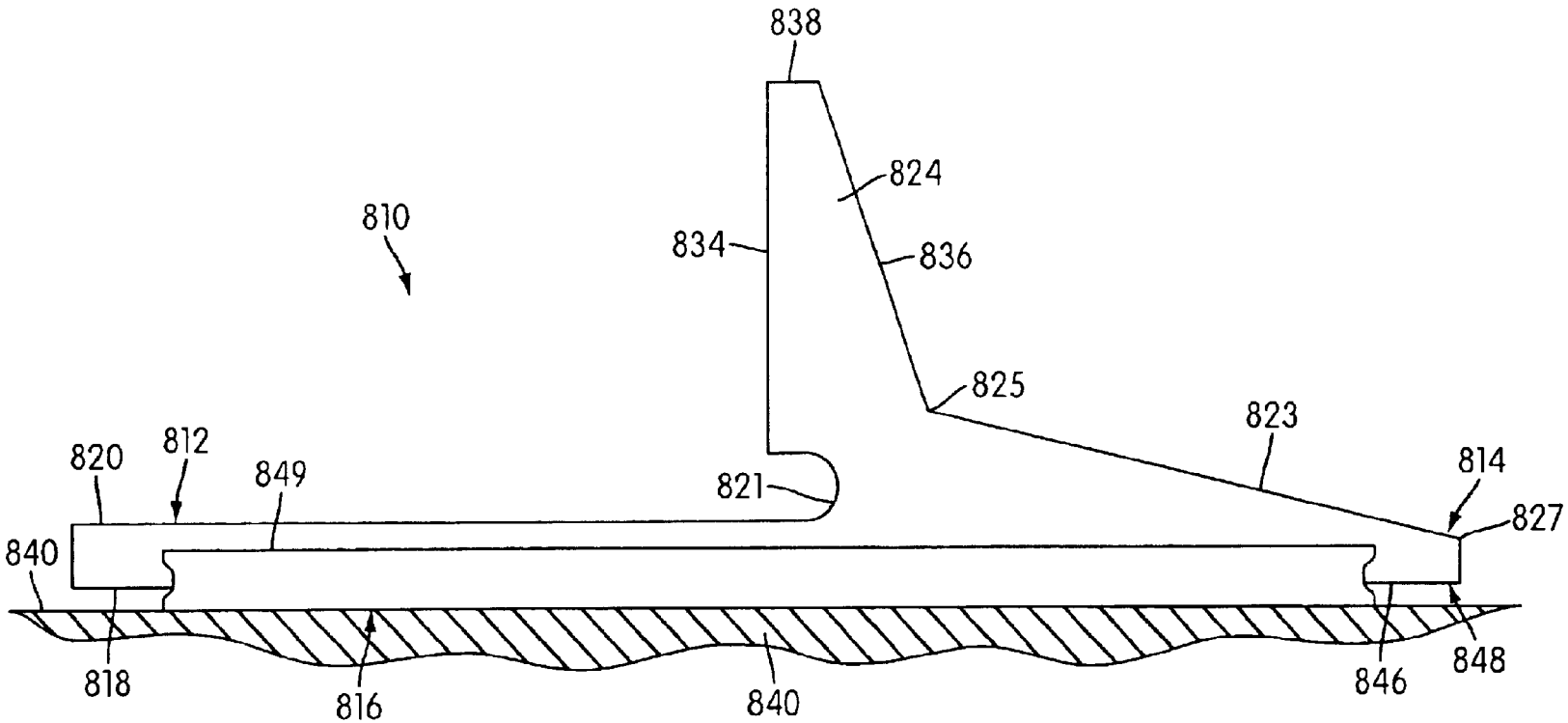

FIG. 20 shows a profile for a guiding device 810 comprising an elongated first portion 812 and an elongated second portion 814 coupled to and extending along the entire length of the first portion 812.

The elongated first portion 812 has a generally rectangular shaped cross sectional profile with a downwardly facing bottom surface 818 and a finger-resting surface 820 disposed opposite to the bottom surface 818. The second portion 814 has a generally rectangular shaped cross sectional profile with an upwardly facing scale-supporting section 823, a bottom surface 846 and an upstanding section 824, which is positioned between the scale-supporting section 823 and the first portion 812. The bottom surfaces 818, 846 and the finger-resting surface 820 are substantially flat and the finger-resting surface 820 is substantially parallel to the bottom surface 818.

The upstanding section 824 is a wall projecting upwardly from the finger-resting surface 820 on a first side 834 thereof and projecting upwardly and outwardly away from the upwardly facing scale-supporting section 823 on a second side 836 thereof. A substantially planar uppermost free end 838 is formed at top portions of the first and second sides 834, 836. The first side 834 extends substantially vertically.

The inclined scale-supporting section 823 is inclined with respect to the working surface 840 such that an inner end 841 thereof, which is closest to the free end 838 of the upstanding section 824, is further from the working surface 840 than an opposite, outer end 843 thereof. The outermost part 827 of the inclined scale-supporting section 823 is inclined at a steeper angle (sloping downwardly toward an outermost part 827 of the inclined scale-supporting section 823) than an innermost part 825 of the inclined scale-supporting section 823, which is adjacent the upstanding section 824.

The bottom surface bottom surfaces 818, 846 form a substantially flat contact surface 848 which receives a scale 816 within a scale-receiving cavity 849 formed therein. The scale 816 includes an upwardly facing scale surface 28 that is disposed opposite to the downwardly facing scale surface 26. The scale 816 includes measurement indicia (not shown, but substantially identical to the first measurement 30 shown in FIG. 1) to indicate predetermined lengths along the scale 816. The downwardly facing scale surface 26 is configured to be substantially parallel to the working surface 840 to permit smooth application of the scale 816 on a working surface 840 when the guiding device 810 is placed on the working surface 840.

The scale 816 can be rigidly attached to the contact surface 848, for example, bonded to the scale-receiving cavity 849, to indicate predetermined lengths along the guiding device 810 when the guiding device 810 is placed on the working surface 840.

Figure 21:
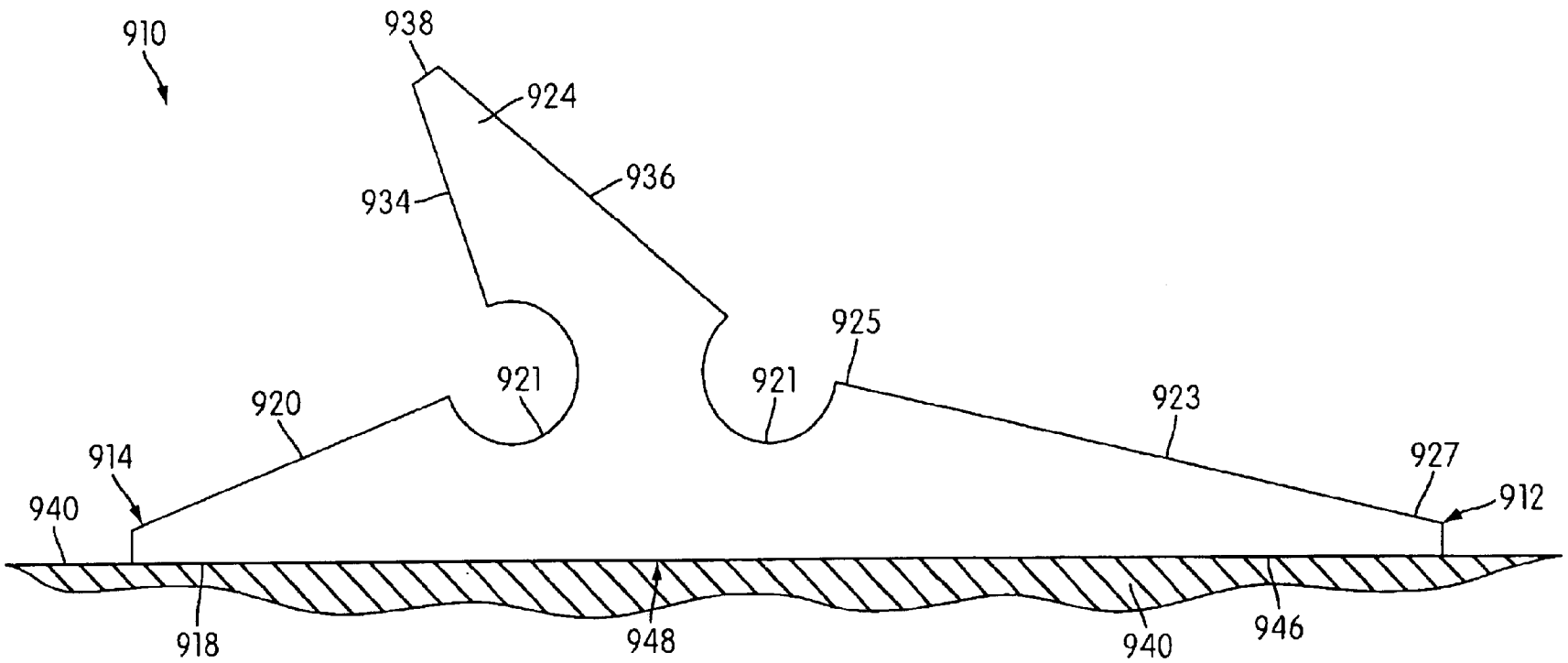

FIG. 21 shows a profile for a guiding device 910 comprising an elongated first portion 912 and an elongated second portion 914 coupled to and extending along the entire length of the first portion 912.

The elongated first portion 912 has a downwardly facing bottom surface 918 and a finger-resting surface 920 disposed opposite to the bottom surface 918. The second portion 914 has an upwardly facing scale-supporting section 923, a bottom surface 946 and an upstanding section 924, which is positioned between the inclined scale-supporting section 923 and the first portion 912. The bottom surfaces 918, 946 and the finger-resting surface 920 are substantially flat and the finger-resting surface 920 is substantially parallel to the bottom surface 918.

The upstanding section 924 is an inclined wall projecting toward the finger-resting surface 920 on a first side 934 thereof and projecting upwardly and outwardly away from the upwardly facing scale-supporting section 923 on a second side 936 thereof. A substantially planar uppermost free end 938 is formed at top portions of the first and second sides 934, 936.

An annular cut-out portion 921 is interposed between the first side 234 and the finger-resting surface 220 and between the second side 936 and the inclined scale-supporting section 923. The annular cut-out portions 921 may be configured to be grasped by a user or to store the guiding device 210, for example.

The inclined scale-supporting section 923 is inclined with respect to the working surface 940 such that an inner end 941 thereof, which is closest to the free end 938 of the upstanding section 924, is further from the working surface 940 than an opposite, outer end 943 thereof. The inclined scale-supporting section 923 is inclined (sloping downwardly toward an outermost part 927 of the inclined scale-supporting section 923).

The first and second sides 934, 936 are inclined toward the first portion 912 such that the first side 934 and the finger-resting portion 920 forms an acute angle and the second side 936 and the inclined scale-supporting section 923 forms an obtuse angle.

The bottom surface 918 of the first portion 912 is configured to be placed against a substantially flat, working surface 940, such as a wall or floor, and the bottom surfaces 918, 946 form a substantially flat contact surface 948 to permit smooth application of the guiding device 910 on a working surface 940 when the guiding device 910 is placed on the working surface 940.

The scale 16 can be rigidly attached to the second portion 914, for example, bonded to the inclined scale-supporting section 923, to indicate predetermined lengths along the guiding device 910.

Figure 22:
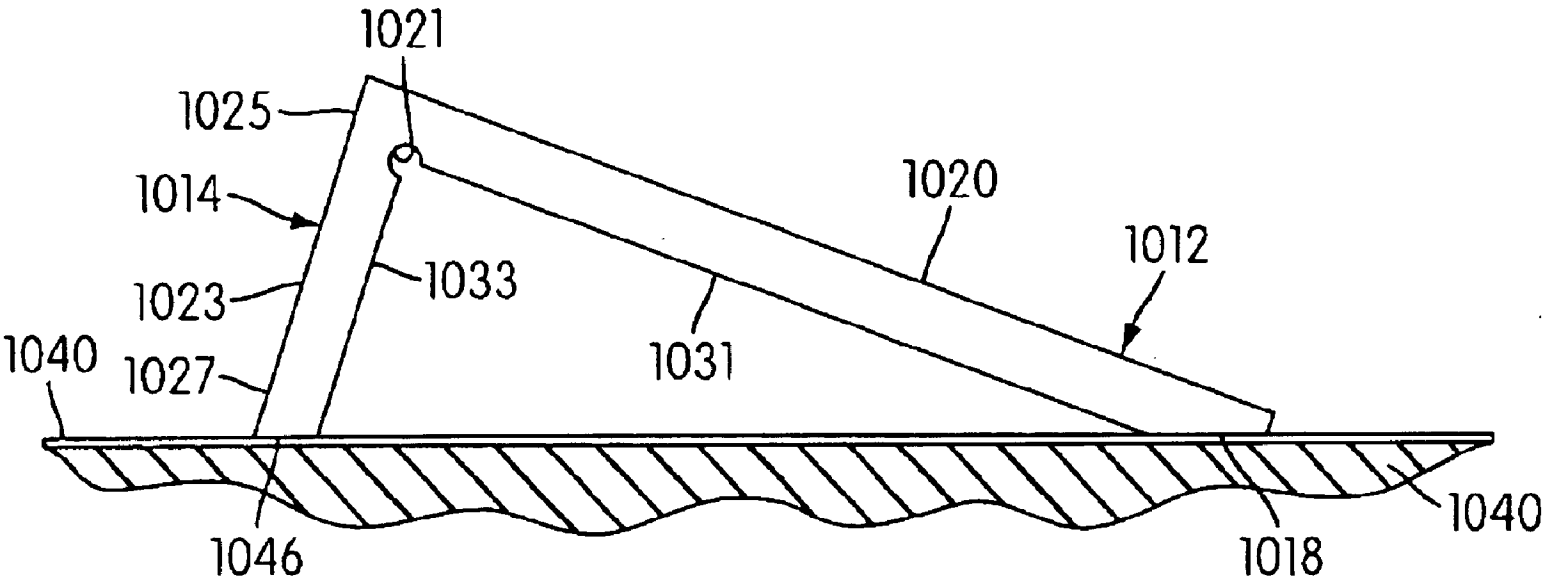

FIG. 22 shows a profile for a guiding device 1010 comprising an elongated first portion 1012 and an elongated second portion 1014 coupled to and extending substantially perpendicular to the first portion 1012.

The elongated first portion 1012 has a downwardly facing bottom surface 1018, a finger-resting surface 1020 disposed at an incline with respect to the bottom surface 1018, an interior surface 1031, which is positioned opposite the finger-resting surface 1020. The second portion 1014 has an inclined scale-supporting section 1023, a bottom surface 1046 and an interior surface 1033, which is positioned opposite the scale-supporting section 1023. The bottom surfaces 1018, 1046 and the finger-resting surface 1020 are substantially flat.

The inclined scale-supporting section 1023 is inclined with respect to the working surface 1040 such that an inner part 1025 thereof, which is closest to the first portion 1012, is further from the working surface 1040 than an opposite, outer part 1027 thereof. The outermost part 1027 of the inclined scale-supporting section 1023 is inclined at a steeper angle (sloping downwardly toward the outermost part 1027 of the inclined scale-supporting section 1023) than the innermost part 1025 of the inclined scale-supporting section 1023, which is adjacent the upstanding section 1024.

The bottom surfaces 1018, 1048 are configured to be placed against a substantially flat, working surface 1040, such as a wall or floor. The bottom surfaces 1018, 1046 form a substantially flat contact surface 1048 to permit smooth application of the guiding device 1010 on a working surface 1040 when the guiding device 1010 is placed on the working surface 1040.

The scale 16 can be rigidly attached to the second portion 1014, for example, bonded to the inclined scale-supporting section 1023, to indicate predetermined lengths along the guiding device 1010.

Figure 23:
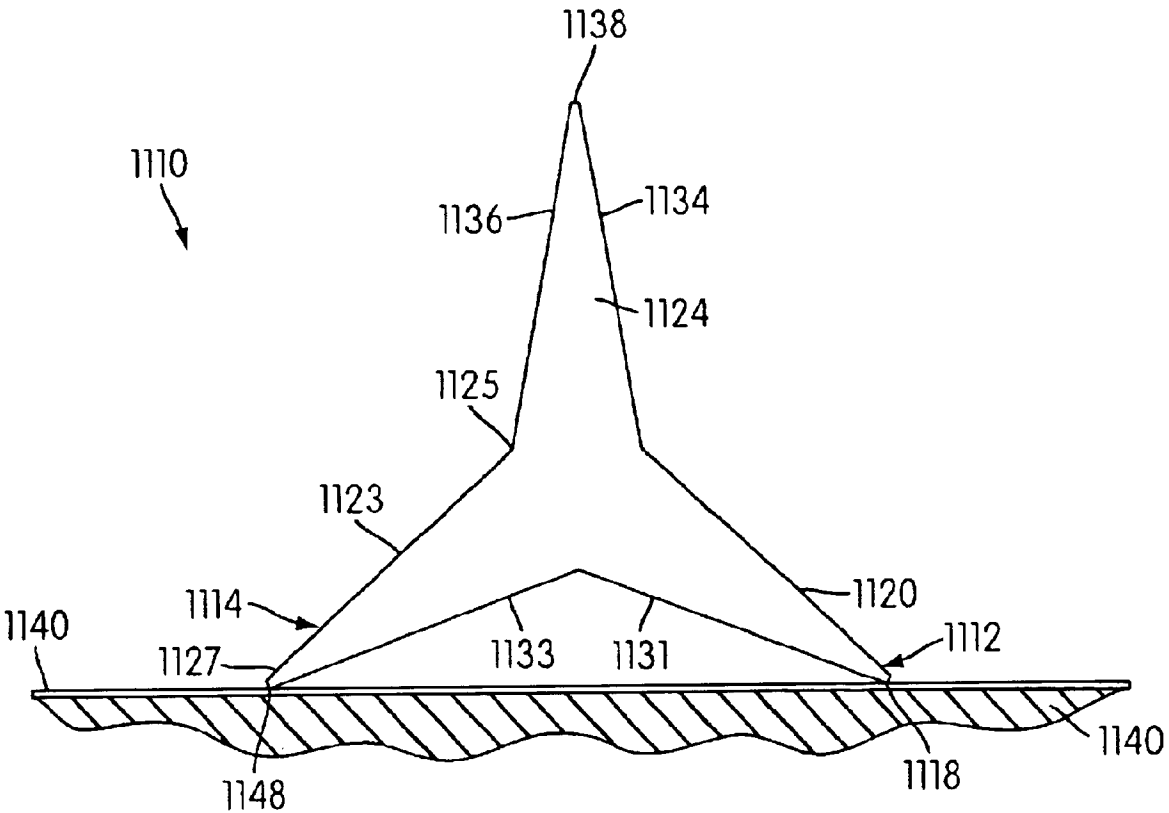

FIG. 23 shows a profile for a guiding device 1110 comprising an elongated first portion 1112 and an elongated second portion 1114 coupled to and extending along the entire length of the first portion 1112. The first and second portions 1112, 1114 are substantially symmetrical to one another.

The elongated first portion 1112 has a generally triangular shaped cross sectional profile with a downwardly facing bottom surface 1118, an inclined finger-resting surface 1120 and an interior surface 1131, which is positioned opposite the finger-resting surface 1120. The second portion 1114 has a generally triangular shaped cross sectional profile with an inclined scale-supporting section 1123, a bottom surface 1146 and an upstanding section 1124, which is positioned between the scale-supporting section 1123 and the first portion 1112. An interior surface 1133 of the second portion 1114 is positioned opposite the scale-supporting section 1023 and abuts the interior surface 1131 of the first portion 1112. It should be understood that inclined finger-resting surface 1120 and inclined scale-supporting section 1123 can be switched such that either inclined surface can receive a scale or fingers of the user, if any scales are received at all.

The upstanding section 1124 is a wall having a generally triangular configuration, projecting upwardly and away from the finger-resting surface 1120 on a first side 1134 thereof and projecting upwardly and away from the inclined scale-supporting section 1123 on a second side 1136 thereof. A substantially pointed uppermost free end 1138 is formed at top portions of the first and second sides 1134, 1136. The first side and second sides 1134, 1136 are inclined to form an obtuse angle with the finger-resting surface 1120 and the scale-supporting section 1123, respectively.

The inclined scale-supporting section 1123 is inclined with respect to the working surface 1140 such that an inner part 1125 thereof, which is closest to the free end 1138 of the upstanding section 1124, is further from the working surface 1140 than an opposite, outer part 1127 thereof. The outermost part 1127 of the inclined scale-supporting section 1123, is inclined at a steeper angle (sloping downwardly toward the outermost part 1127 of the inclined scale-supporting section 1123) than the innermost part 1125 of the inclined scale-supporting section 1123, which is adjacent the upstanding section 1124.

The bottom surfaces 1118, 1146 form a substantially flat contact surface 1148. The contact surface 1148 is configured to be placed against a substantially flat, working surface 1140, such as a wall or floor, to permit smooth application of the guiding device 1110 on a working surface 1140 when the guiding device 1110 is placed on the working surface 1140.

The scale 16 can be rigidly attached to the second portion 1114, for example, bonded to the inclined scale-supporting section 1123, to indicate predetermined lengths along the guiding device 1110.

Figure 24:
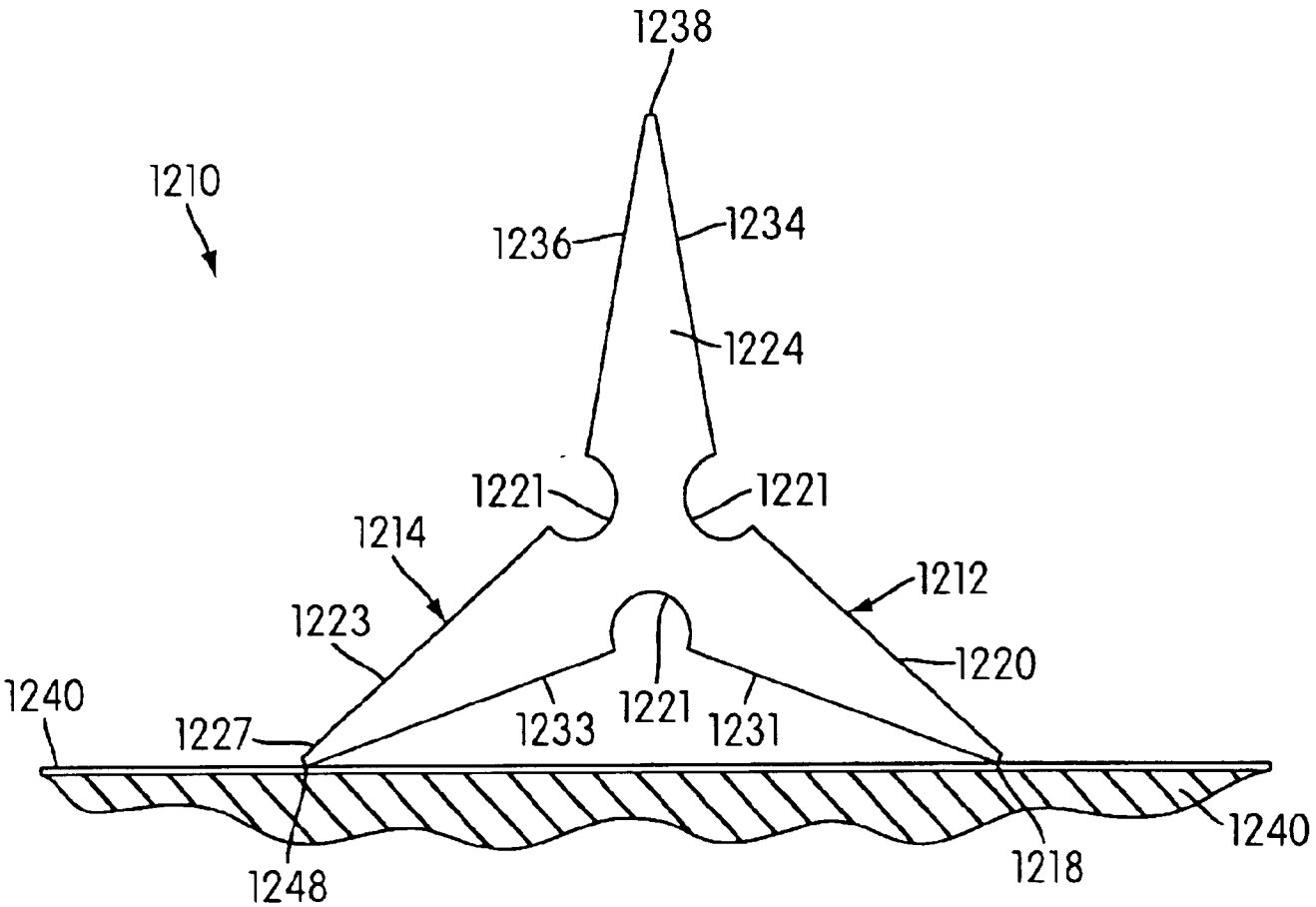

FIG. 24 shows a profile for a guiding device 1210 comprising an elongated first portion 1212 and an elongated second portion 1214 coupled to and extending along the entire length of the first portion 1212. The guiding device 1210 is substantially identical to the guiding device 1110, except for annular cut-out portions.

The elongated first portion 1212 has a generally triangular shaped cross sectional profile with a downwardly facing bottom surface 1218, an inclined finger-resting surface 1220 and an interior surface 1231, which is positioned opposite the finger-resting surface 1220. The second portion 1214 has a generally triangular shaped cross sectional profile with an inclined scale-supporting section 1223, a bottom surface 1246 and an upstanding section 1224, which is positioned between the scale-supporting section 1223 and the first portion 1212. An interior surface 1233 of the second portion 1214 is positioned opposite the inclined scale-supporting section 1223 and abuts the interior surface 1231 of the first portion 1212. It should be understood that inclined finger-resting surface 1220 and inclined scale-supporting section 1223 can be switched such that either inclined surface can receive a scale or fingers of the user, if any scales are received at all.

The upstanding section 1224 is a wall projecting upwardly from the finger-resting surface 1220 on a first side 1234 thereof and projecting upwardly and outwardly away from the inclined scale-supporting section 1223 on a second side 1236 thereof. A substantially planar uppermost free end 1238 is formed at top portions of the first and second sides 1234, 1236. The guiding device 1210 is substantially identical to the guiding device 1110, except that the guiding device 1210 includes annular cut-out portions 1221 interposed between the first side 234 and the finger-resting surface 1220, the second side 1236 and the inclined scale-supporting section 1223, and the interior surfaces 1231, 1233.

The inclined scale-supporting section 1223 is inclined with respect to the working surface 1240 such that an inner part 1225 thereof, which is closest to the free end 1238 of the upstanding section 1224, is further from the working surface 1240 than an opposite, outer part 1227 thereof. The outermost part 1227 of the inclined scale-supporting section 1223 is inclined at a steeper angle (sloping downwardly toward the outermost part 1227 of the inclined scale-supporting section 1223) than the innermost part 1225 of the inclined scale-supporting section 1223, which is adjacent the upstanding section 1224.

The bottom surface 1218 of the first portion 1212 is configured to be placed against a substantially flat, working surface 1240, such as a wall or floor, and the bottom surfaces 1218, 1246 form a substantially flat contact surface 1248 to permit smooth application of the guiding device 1210 on a working surface 1240 when the guiding device 1210 is placed on the working surface 1240.

The scale 16 can be rigidly attached to the second portion 1214, for example, bonded to the inclined scale-supporting section 1223, to indicate predetermined lengths along the guiding device 1210.

Figure 25:
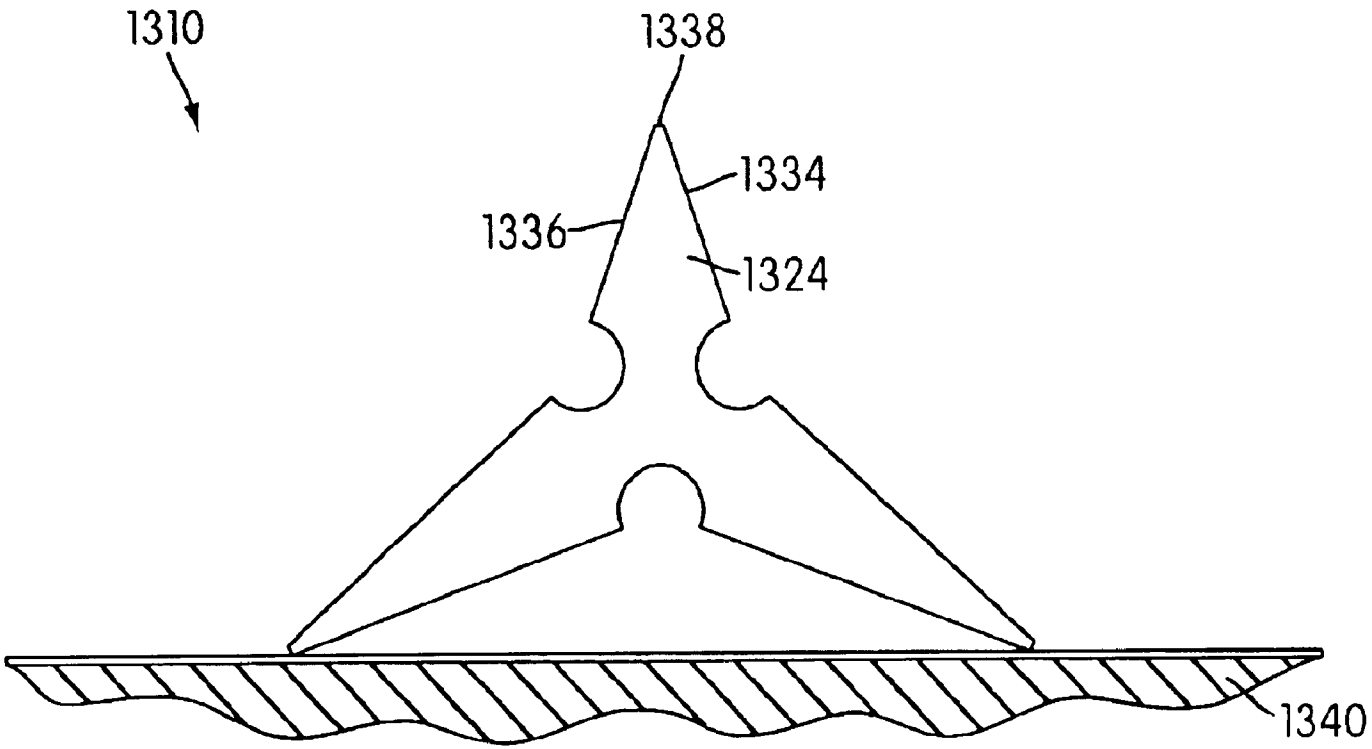

FIG. 25 shows a profile for a guiding device 1310 having a substantially identical configuration as the guiding device 1210, except that the guiding device 1310 includes a shortened upstanding section 1324. The upstanding section 1324 is a shortened wall projecting upwardly from the finger-resting surface 1320 on a first side 1334 thereof and projecting upwardly away from the inclined scale-supporting section 1323 on a second side 1236 thereof. A substantially pointed uppermost free end 1338 is formed at top portions of the first and second sides 1334, 1336.

Figure 26:
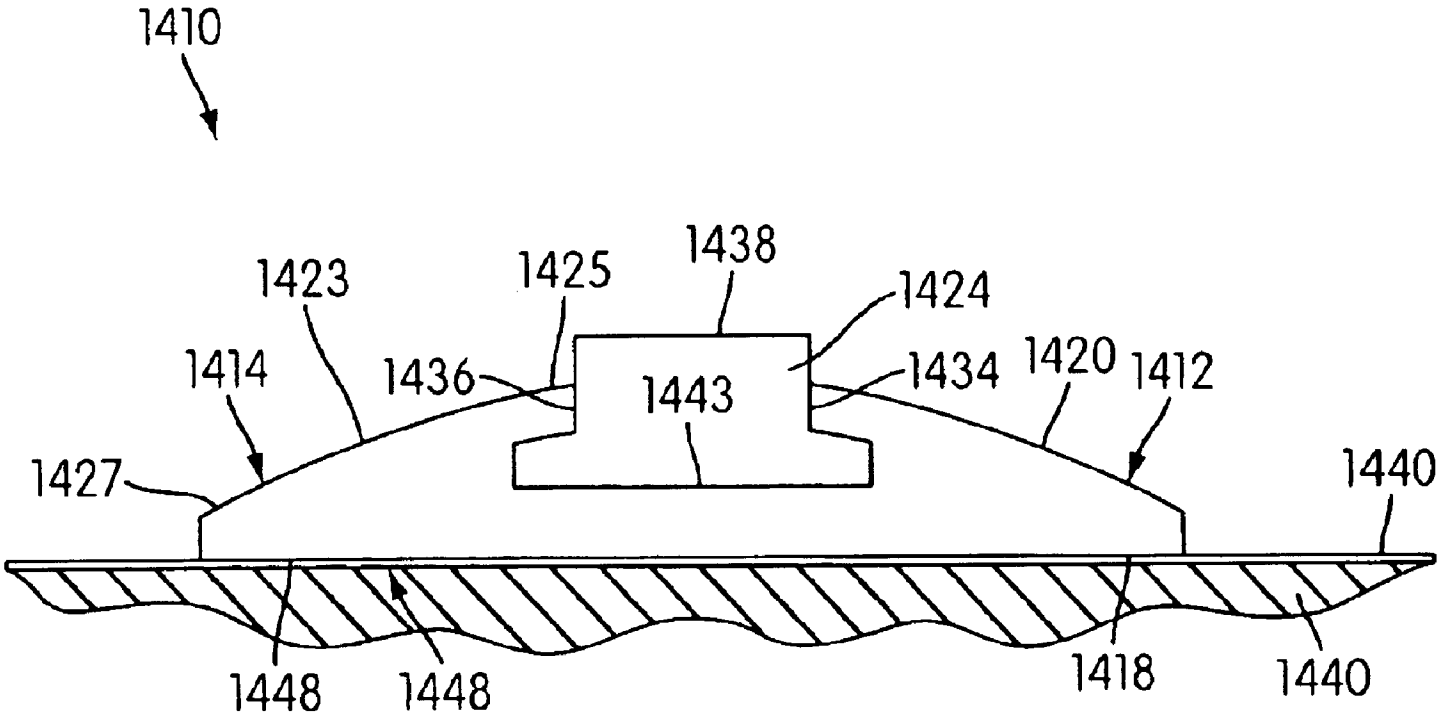

FIG. 26 shows a profile for a guiding device 1410 comprising an elongated first portion 1412 and an elongated second portion 1414 coupled to and extending along the entire length of the first portion 1412.

The elongated first portion 1412 has a downwardly facing bottom surface 1418 and a finger-resting surface 1420 disposed opposite to the bottom surface 1418. The second portion 1414 has an upwardly facing scale-supporting section 1423, a bottom surface 1446 and an upstanding section 1424, which is positioned between the scale-supporting section 1423 and the first portion 1412. The bottom surfaces 1418, 1446 are substantially flat and the finger-resting surface 1420 is inclined with respect to the bottom surface 1418. It should be understood that inclined finger-resting surface 1420 and inclined scale-supporting section 1423 can be switched such that either inclined surface can receive a scale or fingers of the user, if any scales are received at all.

The upstanding section 1424 is a distinct and separate wall projecting upwardly from the finger-resting surface 1420 on a first side 1434 thereof and projecting upwardly from the upwardly facing scale-supporting section 1423 on a second side 1436 thereof. A substantially planar uppermost free end 1438 is formed at top portions of the first and second sides 1434, 1436. The first and second sides 1434, 1436 extend substantially vertically. The upstanding section 1424 is received within a recess 1443 cooperatively formed in the first and second portions 1412, 1414 and may be bonded thereto, for example, by an adhesive or epoxy.

The inclined scale-supporting section 1423 is inclined with respect to the working surface 1440 such that an inner part 1425 thereof, which is closest to the free end 1438 of the upstanding section 1424, is further from the working surface 1440 than an opposite, outer part 1427 thereof. The outermost part 1427 of the inclined scale-supporting section 1423 is inclined at a steeper angle (sloping downwardly toward the outermost part 1427 of the inclined scale-supporting section 1423) than the innermost part 1425 of the inclined scale-supporting section 1423, which is adjacent the upstanding section 1424.

The bottom surface 1418 of the first portion 1412 is configured to be placed against a substantially flat, working surface 1440, such as a wall or floor, and the bottom surfaces 1418, 1446 form a substantially flat contact surface 1448 to permit smooth application of the guiding device 1410 on a working surface 1440 when the guiding device 1410 is placed on the working surface 1440.

The scale 16 can be rigidly attached to the second portion 1414, for example, bonded to the inclined scale-supporting surface 1423, to indicate predetermined lengths along the guiding device 1410.

Figure 27:
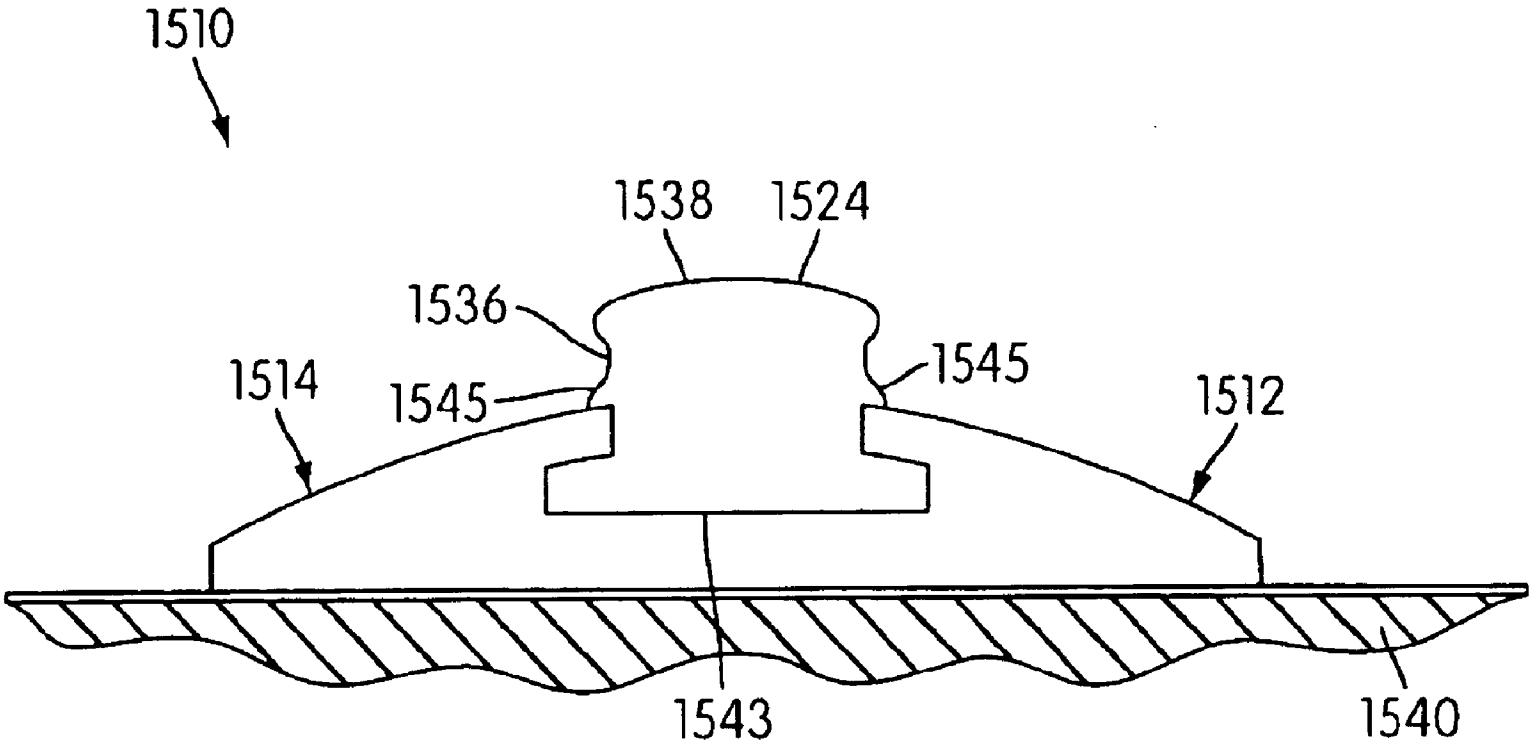

FIG. 27 shows a profile for a guiding device 1510 having a substantially identical configuration as the guiding device 1410, but includes upstanding section 1524 instead of upstanding section 1424. The upstanding section 1524 is disposed between an elongated first portion 1512 and an elongated second portion 1514 coupled to and extending along the entire length of the first portion 1512.

The elongated first portion 1512 has a generally rectangular shaped cross sectional profile with a downwardly facing bottom surface 1518 and a finger-resting surface 1520 disposed opposite to the bottom surface 1518. The second portion 1514 has a generally rectangular shaped cross sectional profile with an upwardly facing scale-supporting section 1523, a bottom surface 1546 and an upstanding section 1524, which is positioned between the scale-supporting section 1523 and the first portion 1512. The bottom surfaces 1518, 1546 and the finger-resting surface 1520 are substantially flat and the finger-resting surface

1520 is substantially parallel to the bottom surface 1518. It should be understood that inclined finger-resting surface 1520 and inclined scale-supporting section 1523 can be switched such that either inclined surface can receive a scale or fingers of the user, if any scales are received at all.

The upstanding section 1524 is a distinct and separate wall projecting upwardly from the finger-resting surface 1520 on a first side 1534 thereof and projecting upwardly from the upwardly facing scale-supporting section 1523 on a second side 1536 thereof. A substantially planar uppermost free end 1538 is formed at top portions of the first and second sides 1534, 1536. The first and second sides 1534, 1536 extend substantially vertically. The upstanding section 1524 is received within a recess 1543 cooperatively formed in the first and second portions 1512, 1514 and may be held therein, for example, by protrusions 1545. The protrusions 1545 may act as fasteners and may retain the upstanding section 1524 in the recess 1543 utilizing a snap-fit arrangement, for example. Also, the protrusions 1545 and the curved shape of section 1524 aid in the gripping of the upstanding section 1524 by the user.

The scale 16 can be rigidly attached to the second portion 1514 to indicate predetermined lengths along the guiding device 1510.

While the principles of the invention have been made clear in the illustrative embodiments set forth above, it will be apparent to those skilled in the art that various modifications may be made to the structure, arrangement, proportion, elements, materials, and components used in the practice of the invention.

For example, although the scale 16 is shown as being rigidly mounted to the second portions 14, 114, etc. in the above described illustrated embodiments, it is contemplated within the principles of the present invention that the scale 16 could be rigidly mounted to either side of the upstanding walls 24, 124, etc. or to one of the first portions 12, 112, etc. of those respective embodiments as well. The second scale 50 could also be coupled, for example, printed on, any of the first portions 12, 112, etc., the second portions 14, 114, etc. or either side of the upstanding walls 24, 124, etc.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A guiding device, comprising:

an elongated finger-resting surface;

an elongated upstanding section projecting upwardly from said finger-resting surface;

an elongated scale-supporting section coupled to and extending along said upstanding section with said upstanding section being positioned between said scale-supporting section and said finger-resting surface, said scale-supporting section being inclined with respect to a guiding device supporting surface; and an elongated first scale made of metal and having a lower surface and an upper surface, said lower surface being rigidly and unreleasably attached to said scale-supporting section and said upper surface having first indicia to indicate predetermined lengths along said first scale, and said supporting surface being substantially flat and positioned directly beneath and along the entire length of said finger-resting surface directly adjacent said upstanding section, and beneath said scale supporting section to permit smooth application of said guiding device on the working surface and an innermost edge of said first scale positioned closest to a free end of said upstanding section, and an outermost edge remote from said innermost edge, and forming a free end of said first scale such that an implement can be moved against said free end of said first scale, wherein the substantially flat supporting surface cooperates with the scale supporting section to define a generally V-shaped cross-section, and wherein said guiding device has a solid cross-sectional configuration, and said finger-resting surface permitting fingers of a user gripping said guiding device to be positioned on said finger-resting surface while being protected from said implement by said upstanding section during movement of the implement along said guiding device adjacent said first scale.

2. A guiding device according to claim 1, wherein said finger-resting surface is substantially flat.

3. A guiding device according to claim 1, wherein said finger-resting surface, said upstanding section, and said scale supporting section are integrally formed as a unitary, one-piece element.

4. A guiding device according to claim 3, wherein said finger-resting surface, said upstanding section, and said scale supporting section are formed of plastic.

5. A guiding device according to claim 1, wherein said first scale has a non-metallic coating on said upper surface.

6. A guiding device according to claim 1, wherein said contact surface includes second indicia indicating predetermined lengths along said contact surface.

7. A guiding device according to claim 6, wherein said second indicia is printing on said contact surface.

8. A guiding device according to claim 1, wherein said contact surface includes an elongated recess.

9. A guiding device according to claim 1, wherein said upstanding section is a wall having a first side facing said first scale and a second side facing said finger-resting surface, with said first side being inclined with respect to said scale-supporting section.

10. A guiding device according to claim 9, wherein said second side includes a plurality of ribs.

11. A guiding device according to claim 9, wherein the first side of the upstanding section is inclined with respect to the second side of the upstanding section.

12. A guiding device according to claim 1, wherein said guiding device has a generally T-shaped cross-section.

13. A guiding device according to claim 1, wherein said upstanding section has a closed free end that contains no upwardly projecting openings.

14. A guiding device according to claim 1, wherein said finger-resting surface is parallel to a first bottom surface positioned beneath said finger-resting surface.

15. A guiding device according to claim 1, wherein said scale-supporting section has a first section end that forms a first free edge for placement against an item to be measured, said scale-supporting section having a second section end that extends to and is connected to said upstanding section, said scale-supporting section has a scale-supporting surface that extends continuously between said first section end and said second section end, and said scale-supporting surface being inclined from said first section end to said second section end.

16. A guiding device according to claim 1, wherein the upstanding section extends along an entire length of the finger resting surface at a uniform height from the finger resting surface.

17. A guiding device, comprising:

an elongated, first portion having a finger-resting surface and a bottom surface opposite to said finger-resting surface;

an elongated, second portion extending along said first portion, said second portion having an upstanding section and an inclined scale-supporting section, said upstanding section projecting upwardly from said finger-resting surface and having an uppermost free end, said upstanding section being positioned between said scale-supporting section and said first portions, said first and second portions having a generally T-shaped cross-section; and an elongated first scale having a lower surface rigidly and unreleasably attached to said scale-supporting section, an upper surface having first indicia to indicate predetermined lengths along said first scale, an innermost edge positioned closest to said free end of said upstanding section, and an outmost edge remote from said innermost edge and forming a free end of said first scale such that an implement can be moved against said free end of said first scale, and said supporting surface being substantially flat and positioned directly beneath and along the entire length of said finger-resting surface directly adjacent said upstanding section, and beneath said scale supporting section to permit smooth application of said guiding device on the working surface and an innermost edge of said first scale positioned closest to a free end of said upstanding section, and an outermost edge remote from said innermost edge, wherein the substantially flat supporting surface cooperates with the scale supporting section to define a generally V-shaped cross-section and wherein said guiding device has a solid cross-sectional configuration, and said bottom surface of said first portion being configured to be placed against a substantially flat working surface, and said upper surface of said first scale being inclined with respect to the working surface such that said innermost edge of said first scale is further from the working surface than said outermost edge of said first scale, and said finger-resting surface permitting fingers of a user gripping said guiding device to be positioned on said finger-resting surface while being protected from said implement by said upstanding section during movement of the implement along said guiding device, adjacent said first scale.

18. A guiding device according to claim 17, wherein each of said finger-resting surface and said first bottom surface of said first portion is substantially flat, and said finger-resting surface is parallel to said first bottom surface.

19. A guiding device according to claim 17, wherein said first portion and said second portion are integrally formed as a unitary, one-piece element.

20. A guiding device according to claim 17, wherein said first portion and said second portion are formed of plastic.

21. A guiding device according to claim 17, wherein said first scale is metal.

22. A guiding device according to claim 17, wherein said bottom surface includes second indicia indicating predetermined lengths along said bottom surface.

23. A guiding device according to claim 17, wherein said upstanding section is a wall having a first side facing said first scale and a second side facing said finger-resting surface, with said first side being inclined with respect to said scale-supporting section.

24. A guiding device according to claim 23, wherein the first side of the upstanding section is inclined with respect to the second side of the upstanding section.

25. A guiding device according to claim 17, wherein said upstanding section includes means for gripping said upstanding section by fingers of a user of said guiding device.

26. A guiding device according to claim 17, wherein said finger-resting surface is substantially flat.

27. A guiding device according to claim 17, wherein said scale-supporting section has a first section end that forms a first free edge for placement against an item to be measured, said scale-supporting section having a second section end that extends to and is connected to said upstanding section, said scale-supporting section has a scale-supporting surface that extends continuously between said first section end and said second section end, and said scale-supporting surface being inclined from said first section end to said second section end.

28. A guiding device according to claim 17, wherein the upstanding section extends along an entire length of the finger resting surface at a uniform height from the finger resting surface.

29. A guiding device, comprising:

an elongated finger-resting surface;

an elongated upstanding section projecting upwardly from said finger-resting surface;

an elongated scale-supporting section coupled to and extending along said upstanding section with said upstanding section being positioned between said scale-supporting section and said finger-resting surface, said scale-supporting section being inclined with respect to a guiding device supporting surface; and an elongated first scale having a lower surface and an upper surface, said lower surface being rigidly and unreleasably attached to said scale-supporting section and said upper surface having first indicia to indicate predetermined lengths along said first scale, and said supporting surface being substantially flat and positioned directly beneath and along the entire length of said finger-resting surface directly adjacent said upstanding section, and beneath said scale supporting section to permit smooth application of said guiding device on the working surface and an innermost edge of said first scale positioned closest to a free end of said upstanding section, and an outermost edge remote from said innermost edge, and forming a free end of said first scale such that an implement can be moved against said free end of said first scale, wherein the substantially flat supporting surface cooperates with the scale supporting section to define a generally V-shaped cross-section, and wherein said guiding device has a solid cross-sectional configuration, and said finger-resting surface permitting fingers of a user gripping said guiding device to be positioned on said finger-resting surface while being protected from said implement by said upstanding section during movement of the implement along said guiding device adjacent said first scale.

30. A guiding device according to claim 29, wherein said upstanding section has a closed free end that contains no upwardly projecting openings.

31. A guiding device according to claim 29, wherein said finger-resting surface is parallel to a first bottom surface positioned beneath said finger-resting surface.

32. A guiding device according to claim 29, wherein said finger-resting surface is substantially flat.

33. A guiding device according to claim 29, wherein said scale-supporting section has a first section end that forms a first free edge for placement against an item to be measured, said scale-supporting section having a second section end that extends to and is connected to said upstanding section, said scale-supporting section has a scale-supporting surface that extends continuously between said first section end and said second section end, and said scale-supporting surface being inclined from said first section end to said second section end.

34. A guiding device according to claim 29, wherein the upstanding section extends along an entire length of the finger resting surface at a uniform height from the finger resting surface.

* * * * *

UNITED STATES PATENT AND TRADEMARK OFFICE

CERTIFICATE OF CORRECTION

PATENT NO. : 6,782,629 B2
DATED : August 31, 2004
INVENTOR(S) : Eduardo J Jimenez et al.

It is certified that error appears in the above-identified patent and that said Letters Patent is hereby corrected as shown below:

Title page,
Item [75], Inventors, "Miguel Mistal, Avon CT (US)" with -- Miguel Nistal, Avon, CT (US) --.

Signed and Sealed this

Fourteenth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,782,629 B2
DATED : August 31, 2004
INVENTOR(S) : Eduardo J. Jimenez et al.

It is certified that error appears in the above-identified patent and that said Letters Patent is hereby corrected as shown below:

Title page,
Item [75], Inventors, replace "Miguel Mistal, Avon CT (US)" with -- Miguel Nistal, Avon CT (US) --.

Signed and Sealed this

Fifteenth Day of March, 2005

JON W. DUDAS
*Director of the United States Patent and Trademark Office*